US011472201B2

(12) United States Patent
Takayama et al.

(10) Patent No.: US 11,472,201 B2
(45) Date of Patent: Oct. 18, 2022

(54) IMAGE RECORDING APPARATUS AND MEDIUM STORING PROGRAM FOR IMAGE RECORDING APPARATUS

(71) Applicant: BROTHER KOGYO KABUSHIKI KAISHA, Nagoya (JP)

(72) Inventors: Haruhisa Takayama, Nagoya (JP); Atsushi Ito, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/499,560

(22) Filed: Oct. 12, 2021

(65) Prior Publication Data

US 2022/0111664 A1 Apr. 14, 2022

(30) Foreign Application Priority Data

Oct. 13, 2020 (JP) ..... JP2020-172373

(51) Int. Cl.
*B41J 11/00* (2006.01)

(52) U.S. Cl.
CPC ..... *B41J 11/00212* (2021.01)

(58) Field of Classification Search
CPC ..... B41J 11/00212
See application file for complete search history.

(56) References Cited

U.S. PATENT DOCUMENTS

2021/0300069 A1* 9/2021 Noda ..... B41J 13/0027

FOREIGN PATENT DOCUMENTS

JP 2010-125674 A 6/2010

* cited by examiner

*Primary Examiner* — Bradley W Thies
(74) *Attorney, Agent, or Firm* — Kenealy Vaidya LLP

(57) ABSTRACT

An image recording apparatus includes: a head which has nozzles configured to discharge a photocurable liquid that is curable by light toward a recording medium, the recording medium including a first base material and a second base material having a surface state different from a surface state of the first base material; a light irradiator which is configured to irradiate the light onto the photocurable liquid disposed on the recording medium; a movement mechanism which is configured to relatively move the recording medium, and the head and the light irradiator in a movement direction; and a controller configured to execute a recording process; an information acquiring process; an irradiation light amount acquiring process; and a first light irradiation process.

20 Claims, 17 Drawing Sheets

FIG. 6A

| FIRST BASE MATERIAL | | SECOND BASE MATERIAL | |
|---|---|---|---|
| SURFACE STATE | | SURFACE STATE | |
| MATERIAL | COLOR | MATERIAL | COLOR |
| ABS | TRANSPARENT | ABS | TRANSPARENT |
| ACRYLIC | WHITE | ACRYLIC | WHITE |
| ⋮ | ⋮ | ⋮ | ⋮ |

FIG. 6B

| SURFACE STATE OF BASE MATERIAL | | CURING CONDITION | |
|---|---|---|---|
| MATERIAL | COLOR | PERMANENT CURING LIGHT AMOUNT (mJ/cm$^2$) | TEMPORARY CURING LIGHT AMOUNT (mJ/cm$^2$) |
| ABS | TRANSPARENT | 10 | 5 |
| | WHITE | 15 | 5 |
| | ... | ... | ... |
| ACRYLIC | TRANSPARENT | 90 | 15 |
| | WHITE | 100 | 20 |
| | ... | ... | ... |
| ... | ... | ... | ... |

| FIRST BASE MATERIAL | |
|---|---|
| SURFACE STATE | |
| MATERIAL | COLOR |
| ABS | TRANSPARENT |
| ACRYLIC | WHITE |

| SECOND BASE MATERIAL | |
|---|---|
| SURFACE STATE | |
| MATERIAL | COLOR |
| ABS | TRANSPARENT |
| ACRYLIC | WHITE |

| THIRD BASE MATERIAL | |
|---|---|
| SURFACE STATE | |
| MATERIAL | COLOR |
| ABS | TRANSPARENT |
| ACRYLIC | WHITE |

| FOURTH BASE MATERIAL | |
|---|---|
| SURFACE STATE | |
| MATERIAL | COLOR |
| ABS | TRANSPARENT |
| ACRYLIC | WHITE |

IMAGE RECORDING APPARATUS AND MEDIUM STORING PROGRAM FOR IMAGE RECORDING APPARATUS

CROSS REFERENCE TO RELATED APPLICATIONS

The present application claims priority from Japanese Patent Application No. 2020-172373, filed on Oct. 13, 2020, the disclosure of which is incorporated herein by reference in its entirety.

BACKGROUND

The present disclosure relates to an image recording apparatus and a program for the image recording apparatus.

Description of the Related Art

Conventionally, an ink-jet image recording apparatus is known, in which an image is record such that a photocurable type ink is discharged from a recording head to a recording material, and the light is irradiated from light irradiating means onto the photocurable type ink on the recording material.

SUMMARY

In the case of the ink-jet image recording apparatus described in Japanese Patent Application Laid-open No. 2010-125674, the light amount is corrected based on the information of the recording material when the image is recorded. However, no image recording method has been investigated for such a situation that a plurality of types of base materials exist on one recording material.

Taking the foregoing circumstances into consideration, an object of the present teaching is to provide an image recording apparatus and a program therefor which make it possible to appropriately record an image on a recording medium including a plurality of types of base materials.

According to a first aspect of the present teaching, there is provided an image recording apparatus including:

a head having nozzles configured to discharge photocurable liquid that is curable by light toward a recording medium, the recording medium including a first base material and a second base material having a surface state different from a surface state of the first base material;

a light irradiator configured to irradiate the light to the photocurable liquid disposed on the recording medium;

a movement mechanism configured to relatively move the recording medium, and the head and the light irradiator in a movement direction; and a controller configured to execute:

discharging the photocurable liquid to the first base material and the second base material while relatively moving the recording medium and the head;

acquiring first position information of the first base material and second position information of the second base material;

acquiring a first irradiation light amount of the light which is to be irradiated to cure the photocurable liquid on the first base material and a second irradiation light amount of the light which is different from the first irradiation light amount and which is to be irradiated to cure the photocurable liquid on the second base material; and irradiating the light in the first irradiation light amount onto the first base material and irradiating the light in the second irradiation light amount onto the second base material based on the first position information and the second position information while relatively moving the recording medium and the light irradiator.

According to a second aspect of the present teaching, there is provided an image recording apparatus including: a head having nozzles configured to discharge photocurable liquid that is curable by light toward a recording medium, the recording medium including a first base material and a second base material different from the first base material;

a light irradiator configured to irradiate the light to the photocurable liquid disposed on the recording medium;

a movement mechanism configured to relatively move the recording medium, and the head and the light irradiator in a movement direction; and a controller configured to execute:

discharging the photocurable liquid to the first base material and the second base material while relatively moving the recording medium and the head;

acquiring first position information of the first base material and second position information of the second base material;

acquiring a first permanent curing light amount which is required to permanently cure the photocurable liquid on the first base material from an uncured state and a second permanent curing light amount which is higher than the first permanent curing light amount and which is required to permanently cure the photocurable liquid on the second base material from an uncured state;

acquiring a first differential light amount obtained by subtracting the first permanent curing light amount from the second permanent curing light amount;

irradiating the light in a third irradiation light amount corresponding to the first permanent curing light amount onto the first base material and the second base material based on the first position information and the second position information while relatively moving the recording medium and the light irradiator; and irradiating the light in a fourth irradiation light amount corresponding to the first differential light amount onto the second base material based on the second position information while relatively moving the recording medium and the light irradiator.

According to a third aspect of the present teaching, there is provided an image recording apparatus including:

a head having nozzles configured to discharge photocurable liquid that is curable by light toward a recording medium, the recording medium including a first base material and a second base material different from the first base material;

a light irradiator configured to irradiate the light to the photocurable liquid disposed on the recording medium;

a movement mechanism configured to relatively move the recording medium, and the head and the light irradiator in a movement direction; and a controller configured to execute:

discharging the photocurable liquid to the first base material and the second base material while relatively moving the recording medium and the head;

acquiring first position information of the first base material and second position information of the second base material;

acquiring a first curing light amount which is required to cure the photocurable liquid on the first base material and a second curing light amount which is required to cure the photocurable liquid on the second base material;

the first curing light amount having a first temporary curing light amount which is required to temporarily cure the photocurable liquid on the first base material from an uncured state and a first permanent curing light amount which is required to permanently cure the photocurable liquid on the first base material from the uncured state; and the second curing light amount having a second temporary curing light amount which is required to temporarily cure the photocurable liquid on the second base material from an uncured state and a second permanent curing light amount which is required to permanently cure the photocurable liquid on the second base material from the uncured state;

acquiring a second differential light amount obtained by subtracting a higher curing light amount as higher one of the first temporary curing light amount and the second temporary curing light amount from the first permanent curing light amount, and a third differential light amount obtained by subtracting the higher curing light amount from the second permanent curing light amount;

irradiating the light in a fifth irradiation light amount corresponding to the higher curing light amount onto the first base material and the second base material based on the first position information and the second position information while relatively moving the recording medium and the light irradiator; and irradiating the light in a sixth irradiation light amount corresponding to the second differential light amount onto the first base material based on the first position information and irradiating the light in a seventh irradiation light amount corresponding to the third differential light amount onto the second base material based on the second position information while relatively moving the recording medium and the light irradiator.

According to a fourth aspect of the present teaching, there is provided a non-transitory medium storing a program for an image recording apparatus including: a head having nozzles configured to discharge photocurable liquid that is curable by light toward a recording medium, the recording medium including a first base material and a second base material having a surface state different from a surface state of the first base material; a light irradiator configured to irradiate the light to the photocurable liquid disposed on the recording medium; a movement mechanism configured to relatively move the recording medium, and the head and the light irradiator in a movement direction; and a controller, and the program causing the controller to execute:

discharging the photocurable liquid to the first base material and the second base material while relatively moving the recording medium and the head;

acquiring first position information of the first base material and second position information of the second base material;

acquiring a first irradiation light amount of the light which is to be irradiated to cure the photocurable liquid on the first base material and a second irradiation light amount of the light which is different from the first irradiation light amount and which is to be irradiated to cure the photocurable liquid on the second base material; and irradiating the light in the first irradiation light amount onto the first base material and irradiating the light in the second irradiation light amount onto the second base material based on the first position information and the second position information while relatively moving the recording medium and the light irradiator.

According to a fifth aspect of the present teaching, there is provided a non-transitory medium storing a program for an image recording apparatus including: a head having nozzles configured to discharge photocurable liquid that is curable by light toward a recording medium, the recording medium including a first base material and a second base material different from the first base material; a light irradiator configured to irradiate the light to the photocurable liquid disposed on the recording medium; a movement mechanism configured to relatively move the recording medium, and the head and the light irradiator in a movement direction; and a controller, and the program causing the controller to execute:

discharging the photocurable liquid to the first base material and the second base material while relatively moving the recording medium and the head;

acquiring first position information of the first base material and second position information of the second base material;

acquiring a first permanent curing light amount which is required to permanently cure the photocurable liquid on the first base material from an uncured state and a second permanent curing light amount which is higher than the first permanent curing light amount and which is required to permanently cure the photocurable liquid on the second base material from an uncured state;

acquiring a first differential light amount obtained by subtracting the first permanent curing light amount from the second permanent curing light amount;

irradiating the light in a third irradiation light amount corresponding to the first permanent curing light amount onto the first base material and the second base material based on the first position information and the second position information while relatively moving the recording medium and the light irradiator; and irradiating the light in a fourth irradiation light amount corresponding to the first differential light amount onto the second base material based on the second position information while relatively moving the recording medium and the light irradiator.

According to a sixth aspect of the present teaching, there is provided a non-transitory medium storing a program for an image recording apparatus including: a head having nozzles configured to discharge photocurable liquid that is curable by light toward a recording medium, the recording medium including a first base material and a second base material different from the first base material; a light irradiator configured to irradiate the light to the photocurable liquid disposed on the recording medium; a movement mechanism configured to relatively move the recording medium, and the head and the light irradiator in a movement direction; and a controller, the program causing the controller to execute:

discharging the photocurable liquid to the first base material and the second base material while relatively moving the recording medium and the head;

acquiring first position information of the first base material and second position information of the second base material; and acquiring a first curing light amount which is required to cure the photocurable liquid on the first base material and a second curing light amount which is required to cure the photocurable liquid on the second base material;

the first curing light amount having a first temporary curing light amount which is required to temporarily cure the photocurable liquid on the first base material from an uncured state and a first permanent curing light amount which is required to permanently cure the photocurable liquid on the first base material from the uncured state; and the second curing light amount having a second temporary curing light amount which is required to temporarily cure the photocurable liquid on the second base material from an uncured state and a second permanent curing light amount which is required to permanently cure the photocurable liquid on the second base material from the uncured state, and the program allowing the controller to further execute:

acquiring a second differential light amount obtained by subtracting a higher curing light amount as higher one of the first temporary curing light amount and the second temporary curing light amount from the first permanent curing light amount, and a third differential light amount obtained by subtracting the higher curing light amount from the second permanent curing light amount;

irradiating the light in a fifth irradiation light amount corresponding to the higher curing light amount onto the first base material and the second base material based on the first position information and the second position information while relatively moving the recording medium and the light irradiator; and irradiating the light in a sixth irradiation light amount corresponding to the second differential light amount onto the first base material based on the first position information and irradiating the light in a seventh irradiation light amount corresponding to the third differential light amount onto the second base material based on the second position information while relatively moving the recording medium and the light irradiator.

The present teaching provides such an effect that it is possible to provide the image recording apparatus which makes it possible to appropriately record an image on a recording medium including a plurality of types of base materials.

The foregoing object, other objects, the feature, and the advantage of the present teaching will be clarified from detailed explanation of preferred embodiments described below with reference to accompanying drawings.

BRIEF DESCRIPTION OF THE DRAWINGS

FIG. 6A depicts the display which displays selection lists for surface states of respective base materials, and FIG. 6B depicts the correspondence relation between the surface state of each of the base materials and the curing condition of each of liquids.

DETAILED DESCRIPTION

Figure 1:
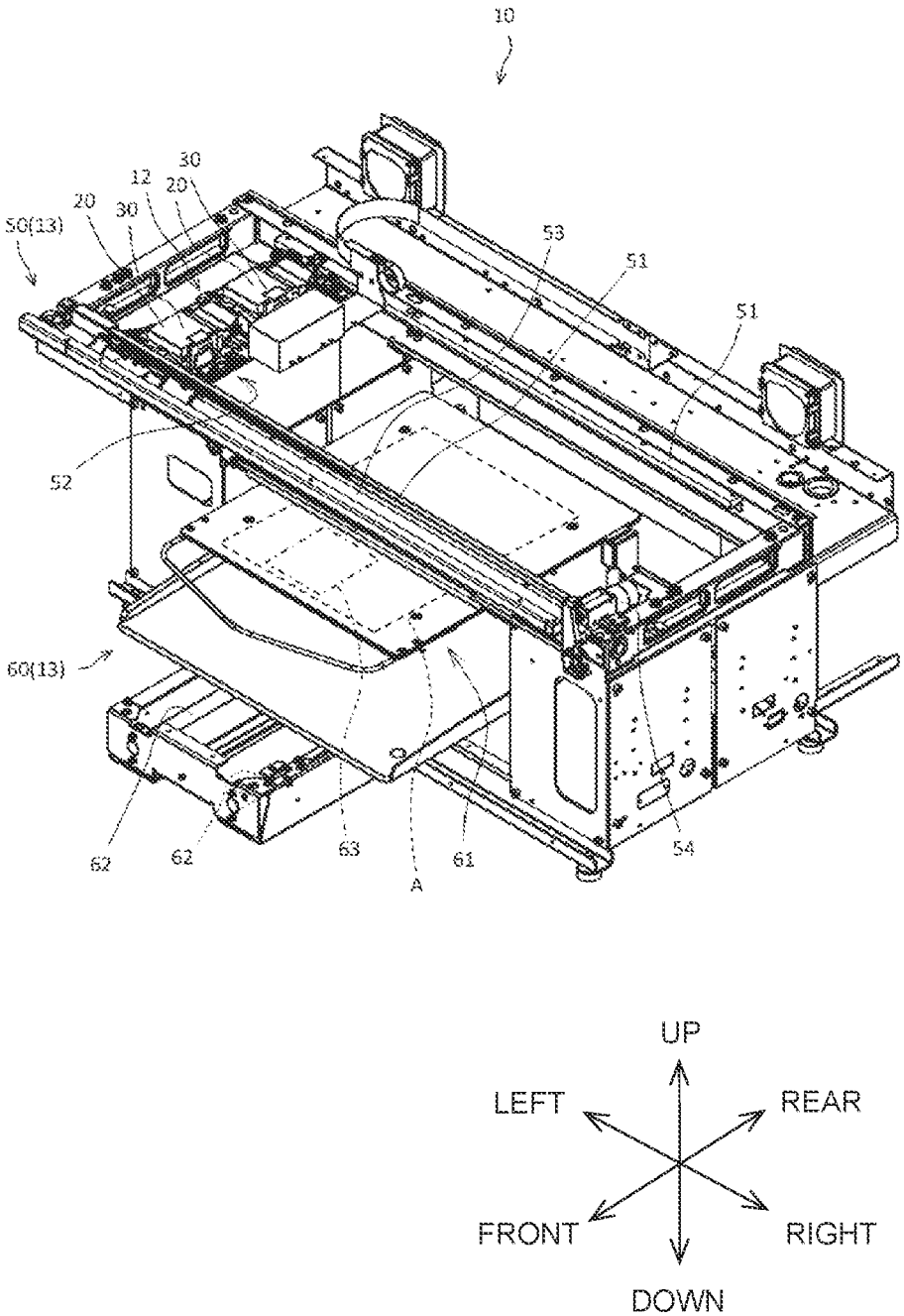
FIG. 1 depicts a perspective view illustrating an image recording apparatus according to a first embodiment of the present teaching, in a state in which a cover of a casing is open.

Embodiments of the present teaching will be specifically explained below with reference to the drawings. Note that in the following description, the same or corresponding elements are designated by the same reference numerals throughout all of the drawings, any duplicate explanation of which will be omitted.

First Embodiment

<Configuration of Image Recording Apparatus>

As depicted in FIG. 1, an image recording apparatus 10 according to a first embodiment of the present teaching is, for example, an ink-jet printer in which a liquid such as an ink or the like is discharged from a head to a recording medium A to print an image. The recording medium A is exemplified by sheets having planar shapes including, for example, cloth or fabric and paper and objects having three-dimensional shapes including, for example, balls and mugs. The image recording apparatus 10 is provided with a head unit 12, a movement mechanism 13, and a controller 40 (see FIG. 2), and the head unit 12 has a head 20 and a light irradiator 30. Note that details of the controller 40 will be described later on.

The movement mechanism 13 has a scanning device 50 and a conveyor 60 which relatively move the recording medium A, and the head 20 and the light irradiator 30 in the movement direction. Note that the scanning direction, in which the head 20 is moved by the scanning device 50, is referred to as "left-right direction", and the conveying direction, in which the recording medium A is conveyed by the conveyor 60, is referred to as "front-back direction". The discharge direction, which is orthogonal to a discharge surface 20*a* (FIG. 3B) for discharging the liquid from the head 20, is referred to as "upward-downward direction". The scanning direction, the conveying direction, and the discharge direction are the directions intersecting with each other (for example, orthogonal to one another). However, the arrangement of the image recording apparatus 10 is not limited thereto.

The scanning device 50 has a pair of scanning rails 51, a carriage 52, a driving belt 53, and a scanning motor 54, and the scanning device 50 moves the head unit 12 in the left-right direction. The pair of scanning rails 51 are lengthy members which extend in the left-right direction. The pair of scanning rails 51 are arranged in parallel to one another so that the head unit 12 is interposed therebetween. The carriage 52 carries the head unit 12, and the carriage 52 is supported by the pair of scanning rails 51 so that the carriage 52 is movable along the scanning rails 51. The driving belt 53 is an endless belt which extends along the scanning rails 51 in the left-right direction. The driving belt 53 is connected to the carriage 52, and the driving belt 53 is connected to the scanning motor 54 via a pulley. The scanning motor 54 reciprocatively moves the carriage 52 in the left-right direction by driving the driving belt 53.

Figure 2:
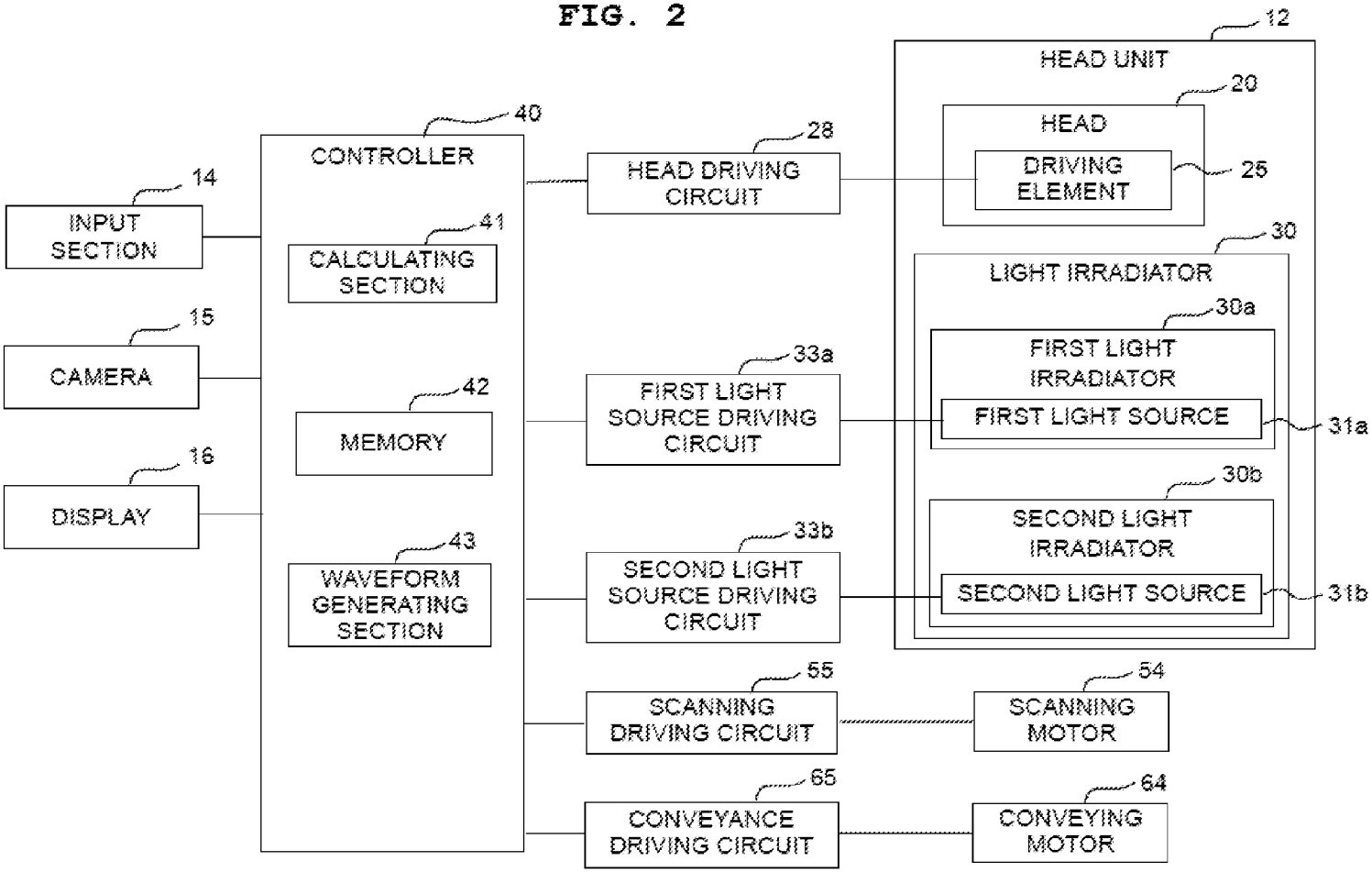
FIG. 2 depicts a functional block diagram illustrating the configuration of the image recording apparatus.

The conveyor 60 has a stage 61, a pair of conveying rails 62, a stage support stand 63, and a conveying motor 64 (FIG. 2). The stage 61 has an upper surface on which the recording medium A is placed, and the space is prescribed in the upward-downward direction between the recording medium A and the head 20. The pair of conveying rails 62 extend in the front-back direction. The stage support stand 63 detachably supports, for example, the stage 61. The stage support stand 63 is supported by the pair of conveying rails 62 movably along the conveying rails 62. The stage support stand 63 is connected to the conveying motor 64. The conveying motor 64 moves the stage 62 along the conveying rails 62 in the front-back direction by driving the stage support stand 63.

Figure 3A:
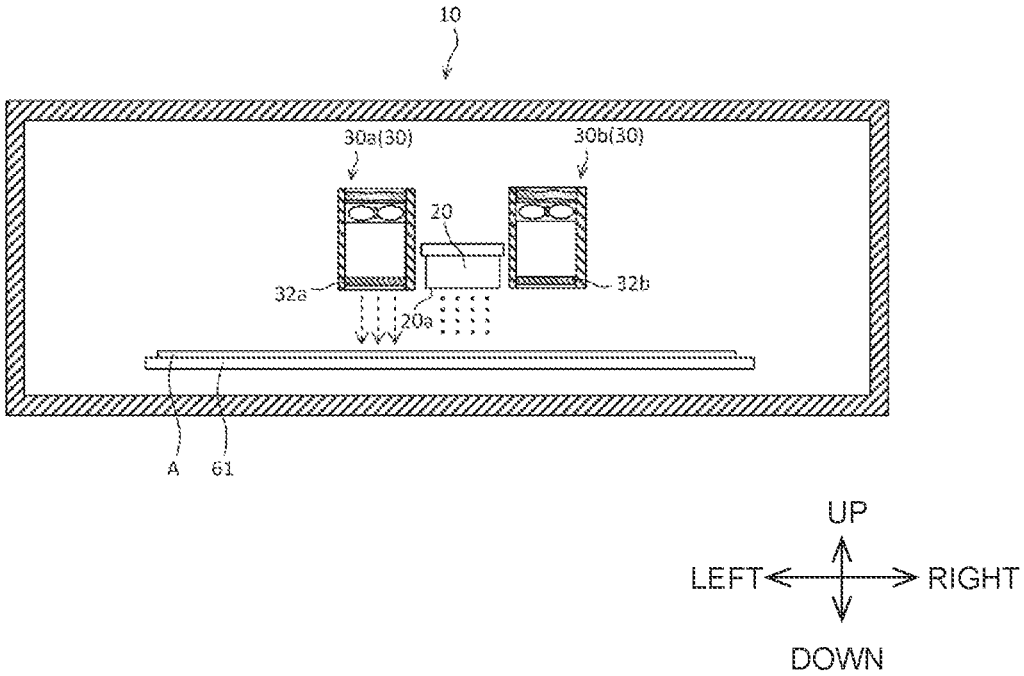
FIG. 3A depicts a sectional view illustrating the image recording apparatus as viewed from a side position.
Figure 3B:
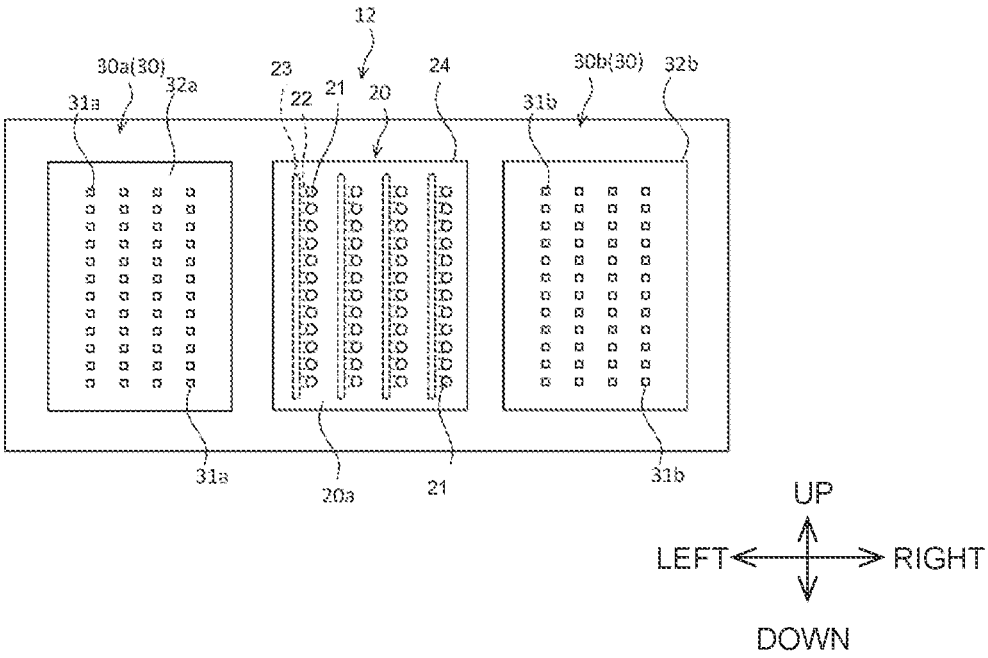
FIG. 3B depicts a head unit as viewed from a lower position.

The head unit 12 is provided with one head 20 or a plurality of heads 20 and one light irradiator 30 or a plurality of light irradiators 30. If the plurality of heads 20 are provided, the plurality of heads 20 are mutually aligned in the front-back direction. As depicted in FIGS. 3A and 3B, the head 20 has a plurality of nozzles 21, a plurality of individual flow passages 22, a common flow passage 23, a flow passage forming member 24, and a plurality of driving elements 25. The flow passage forming member 24 includes the nozzles 21, the individual flow passages 22, and the common flow passage 23 which are formed at the inside thereof. The nozzles 21 are open on the lower surface (discharge surface 20*a*) thereof. The plurality of individual flow passages 22 are branched from the common flow passage 23. The individual flow passage 22 is connected to the common flow passage 23 and the nozzle 21.

The flow of the liquid is divided into those flowing through the plurality of individual flow passages 22 during the period in which the liquid flows through the common flow passage 23. The liquid is supplied to the nozzles 21. The driving element 25 is, for example, a piezoelectric element. The driving element 25 is provided corresponding to the individual flow passage 22, and the driving element 25 drives so that the volume of the individual flow passage 22 is changed. Owing to the driving, the pressure is applied to the liquid contained in the individual flow passage 22 to discharge the liquid from the nozzle 21. Accordingly, the head 20 discharges the photocurable liquid which is curable by the light.

The light irradiator 30 irradiates the light onto the photocurable liquid disposed on the recording medium A. The light is the light which cures the photocurable liquid. The light is, for example, ultraviolet light. For example, as depicted in FIG. 3A, the light irradiator 30 has a first light irradiator 30*a* and a second light irradiator 30*b*. The first light irradiator 30 is arranged adjacently at the left of the head 20, and the second light irradiator 30*b* is arranged adjacently at the hand of the head 20.

For example, when the image recording apparatus 10 performs the bidirectional printing in which the liquid is discharged when the head 20 moves along the outward route and the homeward route in the respective left and right directions, the light irradiator 30, which is included in the pair of light irradiators 30 and which is arranged at the upstream from the head 20 in the movement direction during the printing, irradiates the light. On this account, when the head 20 is moved rightwardly during the printing, the first light irradiator 30*a*, which is arranged at the left of the head 20, irradiates the light. When the head 20 is moved leftwardly during the printing, the second light irradiator 30*b*, which is arranged at the right of the head 20, irradiates the light.

Note that when the image recording apparatus 10 performs the unidirectional printing in which the head 20 discharges the liquid on the outward route while the head 20 does not discharge the liquid on the homeward route, it is enough for the image recording apparatus 10 to have one of the pair of light irradiators 30. For example, when the head 20 is moved rightwardly during the printing, then the first light irradiator 30*a* follows the head 20 for discharging the liquid, and the first light irradiator 30*a* is moved while irradiating the light. On the other hand, when the head 20 is moved leftwardly, it is also allowable that the head 20 does not discharge the liquid, and the first light irradiator 30*a* is moved while irradiating the light onto the ink on the recording medium A having been irradiated once.

The first light irradiator 30*a* has a plurality of first light sources 31*a* and a first light source substrate 32*a* on which the first light sources 31*a* are carried. The first light source 31*a* is, for example, LED which is arranged on the lower surface of the first light source substrate 32*a* to emit the light in order to cure the liquid discharged from the nozzle 21 and landed on the recording medium A. The second light irradiator 30*b* has a plurality of second light sources 31*b* and a second light source substrate 32*b* on which the second light sources 31*b* are carried. The second light source 31*b* is configured in the same manner as the first light irradiator 30*a*. The second light source substrate 32*b* is configured in the same manner as the first light source substrate 32*a*.

<Configuration of Controller>

As depicted in FIG. 2, the controller 40 is connected to an external apparatus including, for example, a computer and a network. The controller 40 receives various data such as the printing data or the like from the external apparatus. Note that the controller 40 may be configured by a single apparatus which performs the centralized control, or the controller 40 may be configured by a plurality of apparatuses which cooperate to one another to perform the decentralized control. The printing data includes the image data (for example, raster data) which designates the image to be printed on the recording medium A.

As depicted in FIG. 2, the controller 40 is connected to an input section 14, a camera 15, and a display 16. The input section 14 is an input device such as a keyboard, a mouse and the like for inputting the information into the controller 40 in accordance with the operation performed by a user. The input section 14 outputs the inputted information to the controller 40. The camera 15 is arranged, for example, so that the recording medium A on the stage 61 can be photographed. An image of the recording medium A on the stage 61 is acquired and outputted to the controller 40. The display 16 is a screen or the like for outputting the information supplied from the controller 40.

The controller 40 has a calculating section 41, a memory 42, and a waveform generating section 43. The memory 42 is a memory which can access the calculating section 41. The memory 42 is configured, for example, by RAM and ROM. RAM temporarily stores various data. The various data are exemplified by printing data and data converted by the calculating section 41. ROM stores programs for performing various data processing. Note that the program may be acquired from any external device or apparatus, or the program may be stored in any other storage medium.

The calculating section 41 is configured, for example, by a processor such as CPU or the like and an integrated circuit such as ASIC or the like. The calculating section 41 executes the program stored in ROM, and thus the controller 40 controls the driving element 25, the first light irradiator 30*a*, the second light irradiator 30*b*, the conveying motor 64, and the scanning motor 54 to perform various processes. For example, the controller 40 executes the data acquiring process, the recording process, the information acquiring process, the curing light amount acquiring process, the irradiation light amount acquiring process, and the first light irradiation process. Details of the respective processes will be described later on.

The waveform generating section 43 generates a waveform signal for defining the waveform of the driving signal outputted to the driving element 25. The waveform signal includes a plurality of types of signals which have different amounts (discharge amounts) of the liquid discharged from the head 20. Further, the calculating section 41 selects one type of the waveform signal from the plurality of types of the waveform signals in relation to every nozzle 21 and every driving cycle of the driving element 25 in accordance with the discharge amount of the liquid for every one drop on the basis of the printing data, and the calculating section 41 generates the waveform selection data (discharge data).

The controller 40 is connected to the driving element 25 via a head driving circuit 28. The controller 40 outputs the waveform signal and the discharge data to the head driving circuit 28. The head driving circuit 28 generates the driving signal on the basis of the discharge data, and the driving signal is outputted to the driving element 25. Then, the driving element 25 is driven in accordance with the driving signal in an order of the outputs, and thus the liquid is discharged from the head 20.

Further, the controller 40 is connected to the scanning motor 54 via a scanning driving circuit 55. The controller 40 outputs the control data of the scanning motor 54 to the scanning driving circuit 55 on the basis of the printing data. Further, the controller 40 is connected to the conveying motor 64 via a conveyance driving circuit 65. The controller 40 outputs the control data of the conveying motor 64 to the conveyance driving circuit 65 on the basis of the printing data. Accordingly, the controller 40 controls, for example, the driving timings, the rotation speeds, and the rotation amounts of the conveying motor 64 and the scanning motor 54.

Further, the controller 40 is connected to the first light source 31*a* via a first light source driving circuit 33*a*. The controller 40 outputs, to the first light source driving circuit 33*a*, the control data of the first light source 31*a* on the basis of the respective pieces of the position information and the respective irradiation light amounts as described later on. The controller 40 is connected to the second light source 31*b* via a second light source driving circuit 33*b*. The controller 40 outputs, to the second light source driving circuit 33*b*, the control data of the second light source 31*b* on the basis of the respective pieces of the position information and the respective irradiation light amounts. Accordingly, the controller 40 controls the turning ON, the turning OFF, and the light amounts of the first light source 31*a* and the second light source 31*b*.

<Printing Process>

In the printing process, the controller 40 controls the scanning motor 54 to execute the movement process including the scanning for moving the head unit 12 rightwardly and the scanning for moving the head unit 12 leftwardly. Further, the controller 40 controls the driving element 25 to execute the discharge process for discharging the liquid from the nozzles 21 of the head 20.

The liquid is discharged from the nozzles 21 while moving the head 20 rightwardly or leftwardly in accordance with the recording process including the movement process and the discharge process. Accordingly, the liquid is landed on the recording medium A which is opposed to the lower surface of the head 20.

Further, the controller 40 controls the light sources 31*a*, 31*b* to execute the first light irradiation process for irradiating the light from the light irradiator 30. In the first light irradiation process, the light is irradiated from one of the light irradiators 30*a*, 30*b* which is disposed upstream in the movement direction of the head 20 for discharging the liquid. Accordingly, the light is irradiated onto the recording medium A opposed to the light source 31*a*, 31*b*. The liquid disposed on the recording medium A is cured by the light, and the liquid is fixed to the recording medium A.

In accordance with the image forming process including the recording process and the first light irradiation process, the image is progressively formed in the left-right direction. Then, the controller 40 controls the conveying motor 64 to execute the conveyance process for conveying the recording medium A frontwardly. Accordingly, the image is formed in the front-back direction. In this way, the printing process is progressively advanced by alternately repeating the image forming process and the conveyance process.

<Data Acquiring Process>

The controller 40 executes the data acquiring process for acquiring the discharge data in order to discharge the photocurable liquid from the head 20. For example, in the data acquiring process, the controller 40 acquires the image data such as the raster data or the like from the printing data. The controller 40 divides the image into areas (pixels) in predetermined unit, and the controller 40 acquires the density of the image for each of the pixels. The controller 40 makes reference to a predetermined correspondence relation to select the waveform signal corresponding to the density for each of the pixels from a plurality of types of waveform signals, and the controller 40 generates the waveform selection data (discharge data). Note that the correspondence relation between the density of the image and the waveform signal is predetermined, which is stored in the memory 42.

Further, the controller 40 allots the discharge data to the nozzle 21 for discharging the liquid and the driving cycle of the driving element 25 corresponding to the nozzle 21, in accordance with the position of the pixel. Accordingly, the discharge data is generated for each of the nozzles 21 and each of the driving cycles of the driving element 25, in accordance with the discharge amount of the liquid for each one drop on the basis of the image data.

<Information Acquiring Process>

Figure 4A:
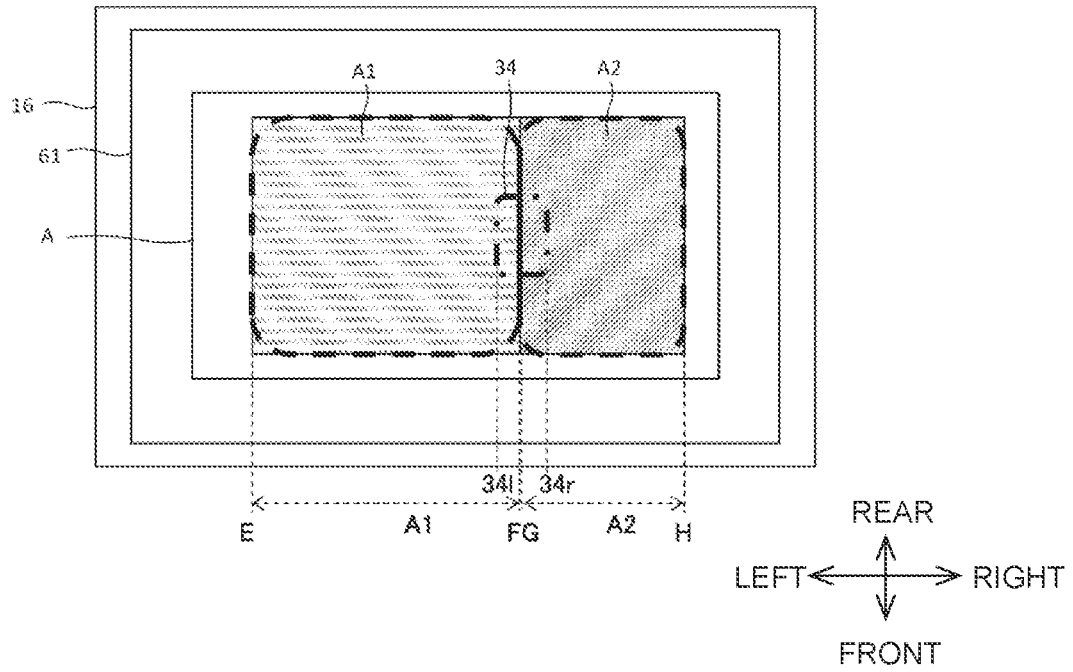
FIG. 4A depicts a display which displays a recording medium, and FIG. 4B schematically depicts the irradiation light amount when the light is irradiated from a light irradiator onto the recording medium.

The controller 40 executes the information acquiring process for acquiring the first position information of a first base material A1 and the second position information of a second base material A2. For example, as depicted in FIG. 4A, the controller 40 acquires the image of the recording medium A on the stage 61 by means of the camera 15, and the image is outputted to the display 16. The recording medium A is provided with the first base material A1 and the second base material A2. The first base material A1 and the second base material A2 are arranged while being brought in contact with each other in the left-right direction.

In relation thereto, the user views the image on the display 16, and the user inputs the position of the first base material A1 and the position of the second base material A1 by means of the input section 14 as depicted by broken lines. Accordingly, the controller 40 acquires the first position information to indicate the position of the first base material A1 and the second position information to indicate the position of the second base material A2 from the input section 14 according to the input information fed from the input section 14. The first position information has the position of the first left end E and the position of the first right end F of the first base material A1. The second position information has the position of the second left end G and the position of the second right end H of the second base material A2. For example, the position information is represented by the coordinate position on the basis of the predetermined position on the state 61, in which the left-right direction is the X direction and the front-back direction is the Y direction.

Note that if the controller 40 can recognize the image, then the image of the recording medium A may be acquired by the camera 15, and the base materials A1, A2 may be extracted from the image to acquire the position information of the base materials A1, A2. In this case, it is also allowable that the controller 40 does not display the image of the recording medium A on the display 16.

<Curing Light Amount Acquiring Process>

The controller 40 executes a curing light amount acquiring process for acquiring a first curing light amount which is required to cure the photocurable liquid on the first base material A1 and a second curing light amount which is required to cure the photocurable liquid on the second base material A1. Note that in the following description, the photocurable liquid on the first base material A1 is sometimes referred to as "first liquid", and the photocurable liquid on the second base material A2 is sometimes referred to as "second liquid".

In the exemplary case depicted in FIG. 4A, the lower surface of the first base material A1 and the lower surface of the second base material A2 are opposed to the upper surface of the stage 61, and the upper surface of the first base material A1 and the upper surface of the second base material A2 are opposed to the discharge surface 20*a* of the head 20 (FIG. 3B), in the state in which the recording medium A is placed on the stage 61. The upper surface of the first base material A1 and the upper surface of the second base material A2 have mutually different surface states. For example, the surface state may differ between the first base material A1 and the second base material A2 on account of mutually different qualities of materials. Further, the surface state may differ between the first base material A1 and the second base material A2 on account of mutually different colors. Further, at least one of the surface roughness, the wettability of the surface, the percentage content of water of the surface, the water absorbing property, the light absorbing performance, the light reflecting performance, and the temperature increase performance brought about by the absorption of light may differ between the first base material A1 and the second base material A2. In other words, any parameter of the parameters which affect the curing of the photocurable liquid may differ between the first base material A1 and the second base material A2. Even when the qualities of materials are identical with each other, if the parameter differs, then it is possible to use the materials as the first base material A1 and the second base material A2.

For example, as depicted in FIG. 6A, the controller 40 displays, on the display 16, selection lists for the surface state of the base material having the same number as that of the pieces of position information inputted in the information acquiring process described above. In relation thereto, the user views the selection lists of the surface state on the display 16, and the user selects, by the input section 14, one quality of material and one color from the selection list for the quality of material and the selection list for the color in relation to each of the first base material A1 and the second base material A2 as depicted by broken lines. In the exemplary case depicted in FIG. 6A, the first base material A1 is transparent acrylonitrile-butadiene-stylene copolymerization synthetic resin (ABS), and the second base material A2 is white acrylic resin.

The controller 40 acquires the first curing light amount which corresponds to the surface state of the first base material A1 and the second curing light amount which corresponds to the surface state of the second base material A2. For example, as depicted in FIG. 6B, the surface state of the base material and the curing condition of each of the liquids are stored in the memory 42, while being previously correlated with each other. The temporary curing resides in such a state that the viscosity is higher than that of the liquid in the uncured state provided immediately after the landing, but the liquid is not cured completely. In this state, the viscosity of the liquid is raised to a viscosity at which the liquid does not flow on the recording medium A. Specifically, the temporary curing resides in a gel state. The permanent curing resides in such a state that the liquid is completely cured. Specifically, in this state, the ink does not stick or adhere to the hand even if the liquid such as the ink or the like is touched by hand.

The permanent curing light amount is the light energy ($mJ/cm^2$) required to permanently cure the uncured liquid per unit area on the base material A1, A2. The temporary curing light amount is the light energy ($mJ/cm^2$) required to temporarily cure the uncured liquid per unit area on the base material A1, A2. Each of the permanent curing light amount and the temporary curing light amount is the integrated light amount obtained by multiplying the irradiation illuminance ($mW/cm^2$) by the light irradiation time (s). The irradiation illuminance is the light energy ($mW/cm^2$) per unit time per unit area on the recording medium A of the light irradiated from the light irradiator 30. The integrated light amount is the light energy ($mJ/cm^2$) per unit area on the recording medium A of the light irradiated from the light irradiator 30.

For example, the controller 40 acquires the light amount (first temporary curing light amount L1*a*) of 5 ($mJ/cm^2$) for temporarily curing the first liquid and the light amount (first permanent curing light amount L1*b*) of 10 (mJ/cm$^2$) for permanently curing the first liquid on the basis of the correspondence information depicted in FIG. 6B. Further, the controller 40 acquires the curing light amount (second temporary curing light amount L2*a*) of 20 (mJ/cm$^2$) for temporarily curing the second liquid and the light amount (second permanent curing light amount L2*b*) of 100 (mJ/cm$^2$) for permanently curing the second liquid on the basis of the correspondence information depicted in FIG. 6B.

<Irradiation Light Amount Acquiring Process>

The controller 40 executes the irradiation light amount acquiring process for acquiring a first irradiation light amount of the light irradiated to cure the photocurable liquid on the first base material A1 and a second irradiation light amount of the light irradiated to cure the photocurable liquid on the second base material A2, the second irradiation light amount being different from the first irradiation light amount.

For example, the controller 40 acquires the first permanent curing light amount L1*b* as the first irradiation light amount (first permanent irradiation light amount) of the light irradiated to permanently cure the uncured first liquid. The controller 40 acquires the first temporary curing light amount L1*a* as the first irradiation light amount (first temporary irradiation light amount) of the light irradiated to temporarily cure the uncured first liquid. Further, the controller 40 acquires the second permanent curing light amount L2*b* as the second irradiation light amount (second permanent irradiation light amount) of the light irradiated to permanently cure the uncured second liquid. The controller 40 acquires the second temporary curing light amount L2*a* as the second irradiation light amount (second temporary irradiation light amount) of the light irradiated to temporarily cure the uncured second liquid.

<Recording Process>

The controller 40 executes the recording process for discharging the photocurable liquid to the first base material A1 and the second base material A2 on the basis of the discharge data, while relatively moving the recording medium A and the head 20. Accordingly, the liquid, which is in a discharge amount based on the discharge data, is discharged from the nozzles 21, and the liquid is landed on the first base material A1 and the second base material A2.

<First Light Irradiation Process>

The controller 40 executes the first light irradiation process for irradiating the light in the first irradiation light amount onto the first base material A1 and irradiating the light in the second irradiation light amount onto the second base material A2 on the basis of the first position information and the second position information, while relatively moving the recording medium A and the light irradiator 30.

Figure 4B:
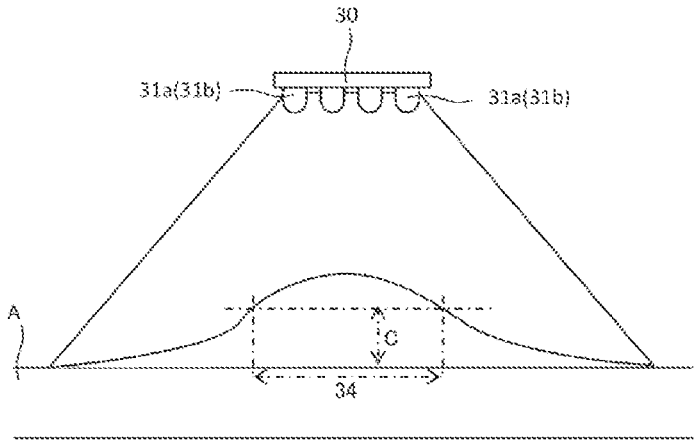

For example, as depicted in FIG. 4B, when the light irradiator 30 irradiates the light onto the recording medium A, the light amount on the recording medium A (irradiation illuminance (mW/cm$^2$)) is more increased at positions disposed nearer to the center of the light irradiator 30 of the head 20 in the direction orthogonal to the upward-downward direction. The range, in which the irradiation illuminance is not less than a predetermined light amount C, is designated as "light irradiation range 34". The predetermined light amount C is the irradiation illuminance at which the curing of the liquid is advanced on the recording medium A.

Figure 7A:
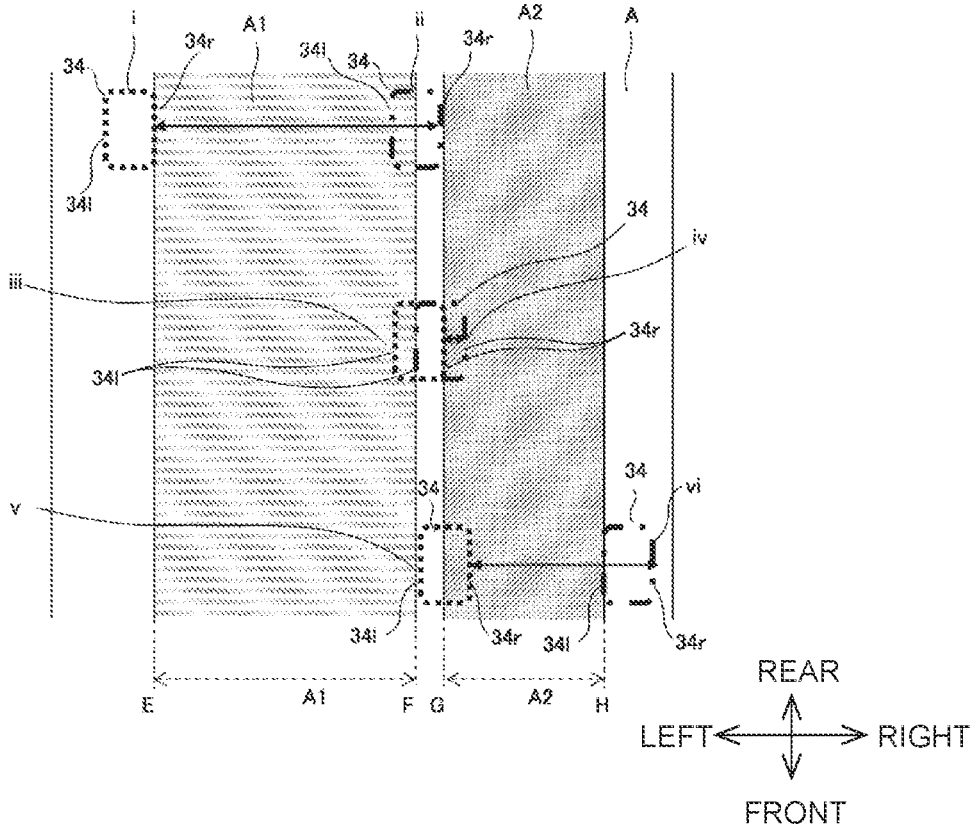
FIG. 7A explains the timing for switching the light amount if the space between the first base material and the second base material is less than the light irradiation range, and FIG. 7B explains the timing for switching the light amount if the space between the first base material and the second base material is not less than the light irradiation range.

For example, the controller 40 compares the position information acquired in the information acquiring process with the light irradiation range 34 to calculate the range in which the light is irradiated from the light irradiator 30. In an exemplary case depicted in FIG. 7A, the space between the first base material A1 and the second base material A2 is narrower than the light irradiation range 34 in the left-right direction. In this case, the first base material A1 and the second base material A2 are included in the light irradiation range 34 at the space between the first base material A1 and the second base material A2. At this mixture position, the controller 40 irradiates the light in the irradiation light amount which is selected as the larger light amount from the first irradiation light amount and the second irradiation light amount. Note that at the mixture position, the controller 40 may adopt, as the irradiation light amount, the larger light amount selected from the first curing light amount and the second curing light amount.

On this account, during the scanning with the light irradiator 30, if the light irradiation range 34 is positioned at the mixture position between the position iii (the right end 34*r* of the light irradiation range 34 is positioned at the second left end G of the second base material A2 and the left end 34*l* of the light irradiation range 34 is positioned at the left of the first right end F of the first base material A1) and the position vi (the left end 34*l* is located at the first right end F of the first base material A1 and the right end 34*r* is located at the right of the second left end G of the second base material A2), the light irradiation range 34 is overlapped with the first base material A1 and the second base material A2. Therefore, the controller 40 irradiates, onto the first base material A1 and the second base material A2, the light in the second irradiation light amount which is selected from the first irradiation light amount and the second irradiation light amount and which has the higher integrated light amount.

Further, during the scanning with the light irradiator 30, if the light irradiation range 34 is positioned between the position i (the right end 34*r* is positioned at the first left end E) and the position ii (the right end 34*r* is adjacent to the left side of the second left end G), then the light irradiation range 34 is not overlapped with the second base material A2, but the light irradiation range 34 is overlapped with the first base material A1. On this account, the controller 40 irradiates the light in the first irradiation light amount onto the first base material A1.

Further, during the scanning with the light irradiator 30, if the light irradiation range 34 is positioned between the position v (the left end 34*l* is adjacent to the right side of the first right end F) and the position vi (the left end 34*l* is positioned at the second right end H), then the light irradiation range 34 is not overlapped with the first base material A1, but the light irradiation range 34 is overlapped with the second base material A2. On this account, the controller 40 irradiates the light in the second irradiation light amount onto the second base material A2.

Figure 7B:
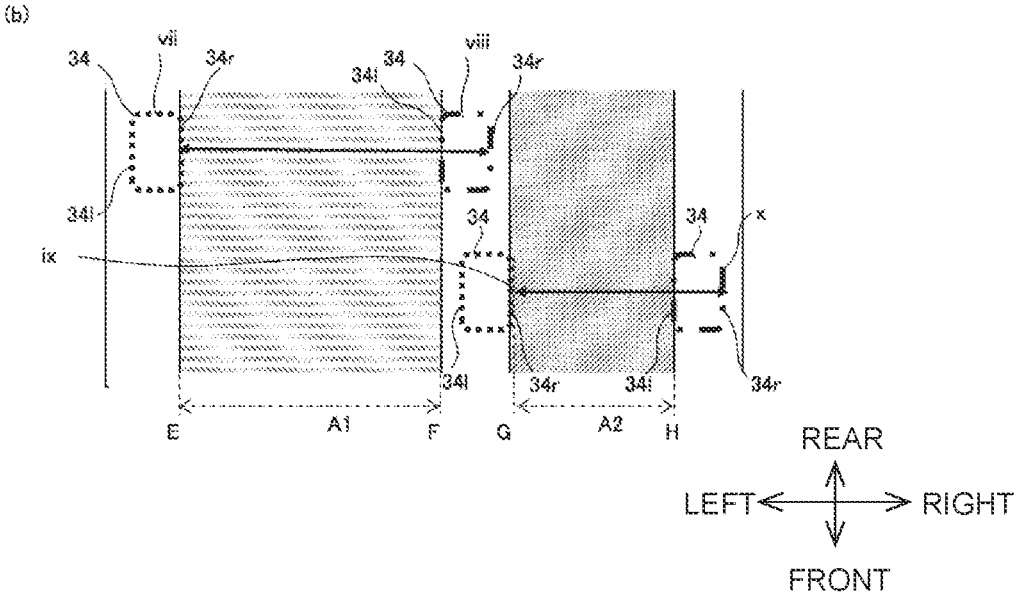

On the other hand, in an exemplary case depicted in FIG. 7B, the space between the first base material A1 and the second base material A2 is the same as the light irradiation range 34 or wider than the light irradiation range 34 in the left-right direction. In this case, in the first light irradiation process, if the light irradiation range 34 on the recording medium A of the light irradiated from the light irradiator 30 is positioned between the first base material A1 and the second base material A2, the controller 40 switches the irradiation light amount between the first irradiation light amount and the second irradiation light amount.

On this account, during the scanning with the light irradiator 30, if the light irradiation range 34 is positioned between the position vii (the right end 34*r* is positioned at the first left end E) and the position viii (the left end 34*l* is positioned at the first right end F), then the light irradiation range 34 is not overlapped with the second base material A2, but the light irradiation range 34 is overlapped with the first base material A1. On this account, the controller 40 irradiates the light in the first irradiation light amount onto the first base material A1.

Further, during the scanning with the light irradiator 30, if the light irradiation range 34 is positioned between the position ix (the right end 34*r* is positioned at the second left end G) and the position x (the left end 34*l* is positioned at the second right end H), then the light irradiation range 34 is not overlapped with the first base material A1, but the light irradiation range 34 is overlapped with the second base material A2. On this account, the controller 40 irradiates the light in the second irradiation light amount onto the second base material A2.

Note that if the space between the first base material A1 and the second base material A2 is wider than the light irradiation range 34, the controller 40 may stop the irradiation by the light irradiator 30 at this space. In this way, if the light irradiation range 34 of the light irradiator 30 is not overlapped with the first base material 1 and the second base material A2, the light irradiator 30 is turned OFF. Thus, it is possible to contemplate the energy saving for the image recording apparatus 10.

<Method for Controlling Image Recording Apparatus>

Figure 5:
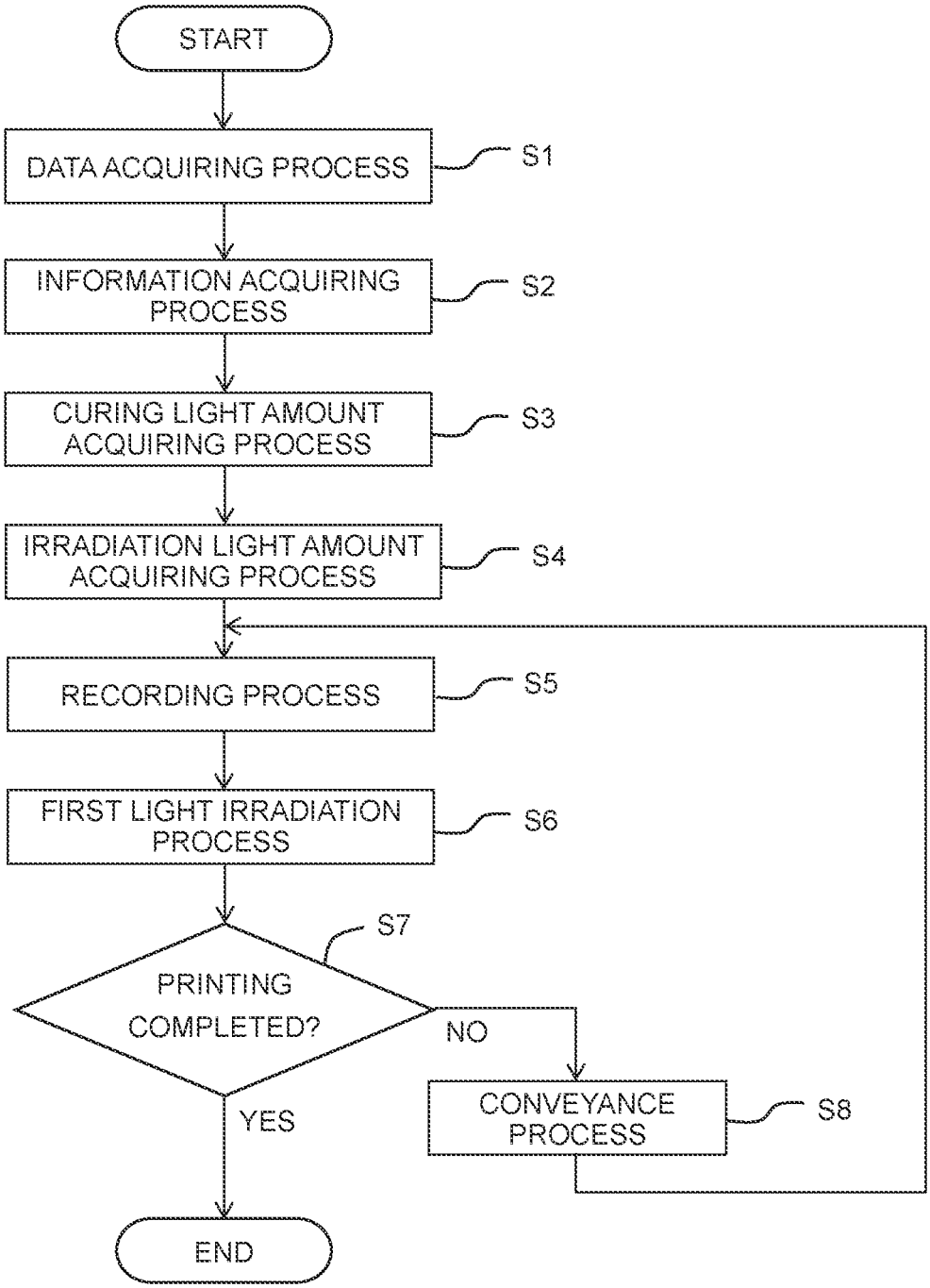
FIG. 5 depicts a flow chart illustrating an exemplary control method for the image recording apparatus.

In the following description, such a case will be explained that the image is recorded by the image recording apparatus 10 on the recording medium A including the first base material A1 and the second base material A2 which has the surface state different from that of the first base material A1 as depicted in FIG. 4A. For example, the control method for the image recording apparatus 10 is executed by the controller 40 in accordance with a flow chart depicted in FIG. 5.

The controller 40 executes the data acquiring process (Step S1). In the data acquiring process, the controller 40 acquires the image data from the printing data, and the controller 40 acquires the density for each of the pixels of the image. The controller 40 selects the waveform signal corresponding to the density for each of the pixels from the plurality of types of waveform signals on the basis of the predetermined correspondence relation between the density and the waveform signal, and the controller 40 acquires the discharge data for each of the nozzles 21 and for each of the driving cycles.

Subsequently, the controller 40 executes the information acquiring process (Step S2). In the information acquiring process, the controller 40 acquires the image of the recording medium A on the stage 61 by means of the camera 15, and the controller 40 outputs the image to the display 16. If the user inputs the position of the first base material A1 and the position of the second base material A2 into the input section 14 on the basis of the image, the controller 40 acquires the first position information which indicates the position of the first base material A1 and the second position information which indicates the position of the second base material A2.

Subsequently, the controller 40 executes the curing light amount acquiring process (Step S3). In the curing light amount acquiring process, as depicted in FIG. 6A, the controller 40 displays, on the display 16, the selection lists for the surface states of the base material (for example, quality of material and color) of the same number as the number of the pieces of the position information inputted in the information acquiring process of Step S2. If the user selects the surface states of the base materials A1, A2 from the selection lists, the controller 40 acquires the surface states of the base materials A1, A2.

The controller 40 acquires the first permanent curing light amount L1*b* of 10 (mJ/cm$^2$) with respect to the transparent ABS for the first base material A1 on the basis of the predetermined correspondence relation relevant to the surface state and the curing condition depicted in FIG. 6B. Further, the controller 40 acquires the second permanent curing light amount L2*b* of 100 (mJ/cm$^2$) with respect to the white acrylic resin for the second base material A2 on the basis of the predetermined correspondence relation relevant to the surface state and the curing condition.

Subsequently, the controller 40 executes the irradiation light amount acquiring process (Step S4). In the exemplary case depicted in FIG. 6A, the controller 40 acquires the first permanent curing light amount L1*b* of 10 (mJ/cm$^2$) as the first irradiation light amount. Further, the controller 40 acquires the second permanent curing light amount L2*b* of 100 (mJ/cm$^2$) as the second irradiation light amount.

Then, the controller 40 executes the recording process (Step S5). In the recording process, the controller 40 controls the scanning motor 54 and the driving element 25 on the basis of the discharge data. Accordingly, the head 20 discharges the liquid in the discharge amount based on the discharge data from the nozzles 21, while moving rightwardly over the first base material A1 and over the second base material A2. Accordingly, the liquid is landed on the first base material A1 and on the second base material A2.

Subsequently, the controller 40 executes the first light irradiation process (Step S6). The controller 40 controls the scanning motor 54 and the driving element 25 on the basis of each of the pieces of position information and each of the irradiation light amounts. Accordingly, for example, if the liquid is discharged while moving the head 20 rightwardly in the recording process, the light is irradiated in the first light irradiation process from the first light irradiator 30*a* disposed upstream in the movement direction from the head 20. On this account, the controller 40 compares the light irradiation range 34 of the first light irradiator 30*a* with the first position information and the second position information.

As a result of the comparison, in the exemplary case depicted in FIG. 4A, if the right end 34*r* of the light irradiation range 34 arrives at the first left end E, then the controller 40 turns ON the first light irradiator 30*a*, and the controller 40 moves the first light irradiator 30*a* rightwardly while allowing the first light irradiator 30*a* to irradiate the light in the first irradiation light amount. Then, the controller 40 allows the first light irradiator 30*a* to irradiate the light in the first irradiation light amount therefrom until the right end 34*r* arrives at the first right end F disposed adjacently to the left side of the second left end G. Accordingly, the light in the first permanent curing light amount L1*b* is irradiated onto the first liquid, and the first liquid is permanently cured and fixed to the first base material A1.

Further, if the right end 34*r* of the light irradiation range 34 arrives at the second left end G, then the controller 40 switches the light from the light in the first irradiation light amount to the light in the second irradiation light amount, and the controller 40 moves the first light irradiator 30*a* rightwardly while irradiating the light in the second irradiation light amount. Then, the controller 40 allows the first light irradiator 30*a* to irradiate the light in the second irradiation light amount therefrom until the left end 34*l* of the light irradiation range 34 arrives at the second left end G. Accordingly, the light in the second permanent curing light amount L2*b* is irradiated onto the second liquid, and the second liquid is permanently cured and fixed to the second base material A2.

If the printing process based on the printing data is not terminated (Step S7: NO), then the conveyance process is executed (Step S8), and the routine returns to the process of Step S5. The recording process of S5, the first light irradiation process of S6, and the conveyance process of S8 are repeatedly executed until the printing process is terminated.

In this way, even when the plurality of types of base materials A1, A2 exist in one recording material, the light is irradiated onto the liquids on the respective base materials A1, A2 in the curing light amounts required to cure the respective liquids. Accordingly, it is possible to cure the respective liquids while reducing the wasteful consumption of the light energy. On this account, it is possible to appropriately record the image on the recording medium A including the plurality of types of base materials A1, A2.

Further, each of the first irradiation light amount and the second irradiation light amount is the integrated light amount per unit area on the recording medium A of the light irradiated from the light irradiator 30. In the first light irradiation process, the controller 40 irradiates the light in the irradiation light amount which is selected as the larger light amount from the first irradiation light amount and the second irradiation light amount, at the mixture position at which the light irradiation range 34 in the movement direction on the recording medium A of the light irradiated from the light irradiator 30 is overlapped with the first base material A1 and the second base material A2. Accordingly, it is possible to cure the respective liquids while reducing the wasteful consumption of the light energy.

Further, the respective liquids are temporarily cured during the identical scanning with the light irradiator 30 which is moved rightwardly or leftwardly. Accordingly, the time required to temporarily cure the liquid after landing the liquid on the first base material A1 can be mutually the same as or approximate to the time required to temporarily cure the liquid after landing the liquid on the second base material A2. On this account, it is possible to obtain the matched textures of the cured products obtained by curing the liquids. For example, if the liquids are temporarily cured before the liquids spread on the base materials A1, A2 after being landed on the base materials A1, A2, the matched textures of mat can be obtained for the cured products. On the other hand, if the liquids are temporarily cured after the liquids spread on the base materials A1, A2 after being landed on the base materials A1, A2, the matched textures of gloss can be obtained for the cured products.

First Modified Embodiment

In an image recording apparatus 10 according to a first modified embodiment, each of the first irradiation light amount and the second irradiation light amount is the irradiation illuminance per unit time per unit area on the recording medium A of the light irradiated from the light irradiator 30. In the first light irradiation process, the controller 40 irradiates the light in the irradiation light amount which is selected from the first irradiation light amount and the second irradiation light amount as the larger light amount, at the mixture position at which the light irradiation range 34 in the movement direction on the recording medium A of the light irradiated from the light irradiator 30 is overlapped with the first base material A1 and the second base material A2.

In this case, the movement speed (cm/s) of the light irradiator 30 and the length (cm) of the light irradiation range 34 of the light irradiated from the light irradiator 30 in the left-right direction are predetermined, and hence the irradiation time (s) of the light on the base material A1, A2 is determined therefrom. The integrated light amount (mJ/cm$^2$) is determined from the product of the light irradiation time (s) and the irradiation illuminance (mW/cm$^2$). Therefore, the irradiation illuminance (mW/cm$^2$) is used as each of the first irradiation light amount and the second irradiation light amount.

For example, in the curing light amount acquiring process, the surface state (for example, quality of material and color) of the base material is previously correlated with the permanent curing light amount and the temporary curing light amount, and they are stored in the memory 42. The permanent curing light amount is the irradiation illuminance (mW/cm$^2$) required to permanently cure the liquid per unit area on the base material A1, A2, and the temporary curing light amount is the irradiation illuminance (mW/cm$^2$) required to temporarily cure the liquid per unit area on the base material A1, A2.

The controller 40 acquires the temporary curing light amount (first temporary curing light amount L1*a*) or the permanent curing light amount (first permanent curing light amount L1*b*) corresponding to the surface state of the first base material A1 as the first irradiation light amount on the basis of the predetermined correspondence information. Further, the controller 40 acquires the temporary curing light amount (second temporary curing light amount L2*a*) or the permanent curing light amount (second permanent curing light amount L2*b*) corresponding to the surface state of the second base material A2 as the second irradiation light amount on the basis of the predetermined correspondence information.

Then, in the first light irradiation process, the controller 40 irradiates the light in the first irradiation light amount onto the first base material A1 from the following light irradiator 30 which follows the head 20 for discharging the liquid, and the controller 40 irradiates the light in the second irradiation light amount onto the second base material A2. The controller 40 irradiates the light in the higher irradiation light amount selected from the first irradiation light amount and the second irradiation light amount at the mixture position at which the first base material A1 and the second base material A2 are overlapped with the light irradiation range 34. Accordingly, it is possible to cure the respective liquids while reducing the wasteful consumption of the light energy.

Second Modified Embodiment

In an image recording apparatus 10 according to a second modified embodiment, the controller 40 accepts, in the information acquiring process, the switching position to switch the irradiation light amount between the first irradiation light amount and the second irradiation light amount of the light irradiated from the light irradiator 30 in the first light irradiation process, and the controller 40 acquires the first position information and the second position information on the basis of the switching position.

Figures 8A, 8B:
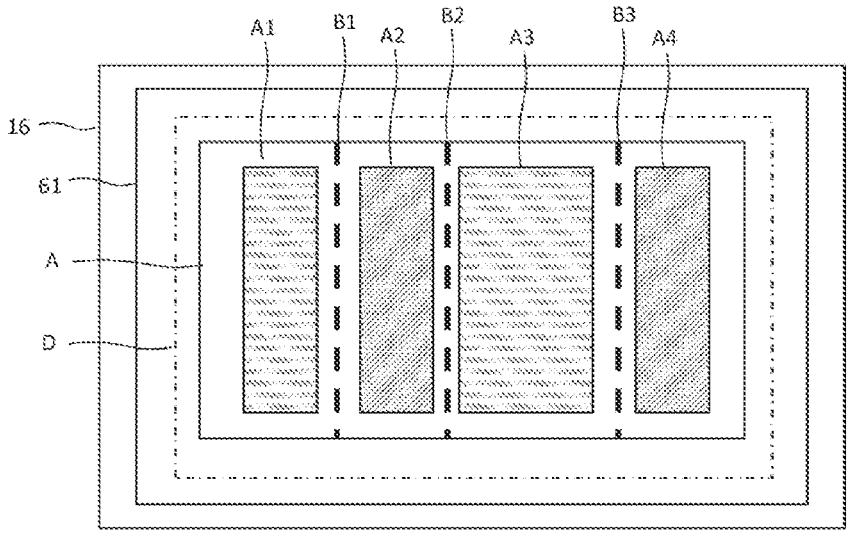
FIG. 8A depicts a display which displays a recording medium in relation to an image recording apparatus according to a second modified embodiment of the present teaching.
FIG. 8B depicts the display which displays selection lists for surface states of respective base materials.

For example, as depicted in FIG. 8A, in the information acquiring process, the controller 40 acquires an image of the recording medium A on the stage 61 by means of the camera 15, and the controller 40 displays the image on the display 16. The user views the image on the display 16, and the user inputs the switching positions between the first base material A1 and the second base material A2 by means of the input section 14. As for the switching positions, the controller 40 designates the first position information of the first base material A1 between the first switching position B1 disposed at the left end and the left end of the range D in which the light can be irradiated from the light irradiator 30. The controller 40 designates the second position information of the second base material A2 between the first switching position B1 and the second switching position B2 disposed adjacently at the left of the first switching position B1. The controller 40 designates the third position information of the third base material A3 between the second switching position B2 and the third switching position B3 disposed adjacently at the left of the second switching position B2. As for the switching positions, the controller 40 designates the fourth position information of the fourth base material A4 between the third switching position B3 disposed at the right end and the right end of the range D in which the light can be irradiated from the light irradiator 30.

As depicted in FIG. 8B, in the curing light amount acquiring process, the controller 40 displays, on the display 16, the selection lists of the surface states of the base materials of the number (for example, 4) obtained by adding 1 to the number of switching positions (for example, 3). In relation thereto, the user selects the surface states of the base materials A1 to A4 from the selection lists by means of the input section 14. Accordingly, the controller 40 acquires the curing light amounts of the base materials A1 to A4 on the basis of the predetermined correspondence relation between the surface state and the curing light amount, for example, as depicted in FIG. 6B.

Then, in the irradiation light amount acquiring process, the controller 40 acquires the curing light amount as the irradiation light amount. After that, in the first light irradiation process, the controller 40 irradiates the light in the respective irradiation light amounts onto the base materials A1 to A4 from the following light irradiator 30 which is moved while following the head 20 for discharging the liquid. In this procedure, the controller 40 irradiates the light in the first irradiation light amount between the left end of the range D and the first switching position B1, and the controller 40 irradiates the light in the second irradiation light amount between the first switching position B1 and the second switching position B2. The controller 40 irradiates the light in the first irradiation light amount between the second switching position B2 and the third switching position B3, and the controller 40 irradiates the light in the second irradiation light amount between the third switching position B3 and the right end of the range D. Accordingly, it is possible to cure the respective liquids while reducing the wasteful consumption of the light energy.

Third Modified Embodiment

In an image recording apparatus 10 according to a third modified embodiment, the controller 40 irradiates the light in the first irradiation light amount if the irradiation position of the light from a predetermined position of the light irradiator 30 is overlapped with the first base material A1 in the first light irradiation process. The controller 40 irradiates the light in the second irradiation light amount if the irradiation position of the light from a predetermined position of the light irradiator 30 is overlapped with the second base material A2.

In this case, if the central position of the light irradiation range 34 corresponding to the predetermined position (for example, center) of the light irradiator 30 is overlapped with the first base material A1, the controller 40 irradiates the light in the first irradiation light amount. Further, if the central position of the light irradiation range 34 is overlapped with the second base material A2, the controller 40 irradiates the light in the second irradiation light amount. Accordingly, it is possible to cure the respective liquids while reducing the wasteful consumption of the light energy. Further, in this case, the central position of the light irradiation range 34 corresponding to the predetermined position is the point, and the point is not overlapped with the first base material and the second base material. In other words, it is unnecessary to take the light irradiation range into consideration, and the irradiation control is simple.

Fourth Modified Embodiment

In an image recording apparatus 10 according to a fourth modified embodiment, the first light irradiation process includes a process in which the photocurable liquid on the first base material A1 is permanently cured from the uncured state by the irradiation performed a predetermined number of times by irradiating the light in the first irradiation light amount once or a plurality of times onto the first base material A1, and a process in which the photocurable liquid on the second base material A2 is temporarily cured from the uncured state by the irradiation performed a predetermined number of times by irradiating the light in the second irradiation light amount once or a plurality of times onto the second base material A2.

Figure 9A:
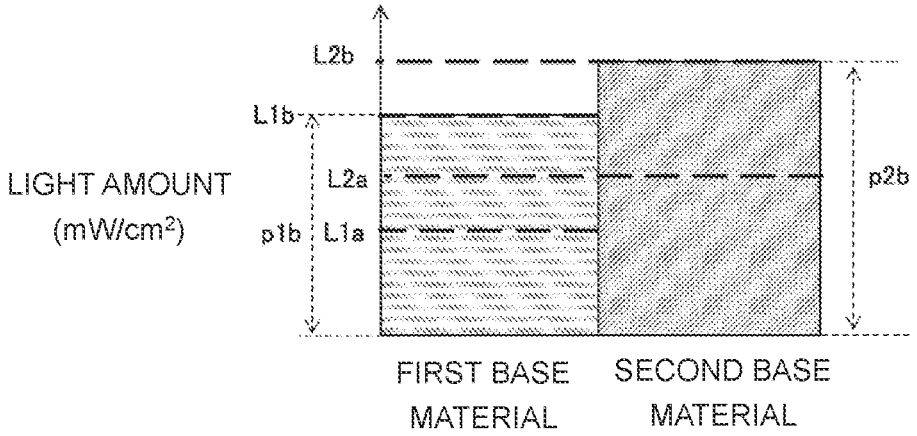
FIGS. 9A and 9B depict graphs illustrating the light amounts for respective base materials in relation to an image recording apparatus according to a fourth modified embodiment of the present teaching.

In an exemplary case depicted in FIG. 9A, the controller 40 acquires the first permanent curing light amount L1*b* and the second permanent curing light amount L2*b* in the curing light amount acquiring process. The first permanent curing light amount L1*b* is the light amount which is required to permanently cure the uncured first liquid. The second permanent curing light amount L2*b* is the light amount which is higher than the first permanent curing light amount L1*b* and which is required to permanently cure the uncured second liquid.

The controller 40 compares, in the irradiation light amount acquiring process, the maximum light amount of the light capable of being irradiated from the light irradiator 30 with the respective curing light amounts. In the exemplary case depicted in FIG. 9A, the maximum light amount of the light irradiator 30 is not less than the second permanent curing light amount L2*b*.

In this case, the controller 40 acquires the first irradiation light amount on the basis of the first permanent curing light amount L1*b*. The first irradiation light amount includes the first permanent irradiation light amount p1*b* of the light irradiated to permanently cure the first liquid from the uncured state by means of the irradiation of the light performed once. The first permanent irradiation light amount p1*b* is equal to the first permanent curing light amount L1*b*. Note that the first permanent irradiation light amount p1*b* may be the light amount which is not less than the first permanent curing light amount L1*b* and less than the second permanent curing light amount L2*b*.

Further, the controller 40 acquires the second irradiation light amount on the basis of the second permanent curing light amount L2*b*. The second irradiation light amount includes the second permanent irradiation light amount p2*b* of the light irradiated to permanently cure the second liquid from the uncured state by means of the irradiation of the light performed once. The second permanent irradiation light amount p2*b* is equal to the second permanent curing light amount L2*b*. Note that the second permanent irradiation light amount p2*b* may be the light amount which is not less than the second permanent curing light amount L2*b*.

Then, the controller 40 executes the recording process during the first scanning, wherein the liquid is discharged from the head 20 while moving the head 20. During the first scanning, the controller 40 executes the first light irradiation process by means of the following light irradiator 30 which follows the head 20 for discharging the light.

In the first light irradiation process, the controller 40 executes the first permanent curing process in which the light in the first permanent irradiation light amount p1*b* is irradiated onto the first base material A1 from the following light irradiator 30, and the second permanent curing process in which the light in the second permanent irradiation light amount p2*b* is irradiated onto the second base material A2 from the following light irradiator 30. Accordingly, it is possible to permanently cure both of the uncured first liquid and the uncured second liquid, while reducing the wasteful consumption of the light energy.

In this procedure, the first temporary curing light amount L1*a*, which is the light amount required to temporarily cure the uncured first liquid, is lower than the first permanent curing light amount L1*b*. Further, the second temporary curing light amount L2*a*, which is the light amount required to temporarily cure the uncured second liquid, is lower than the second permanent curing light amount L2*b*. On this account, during the first scanning in which the liquid is discharged, the first liquid and the second liquid are permanently cured from the uncured states while exceeding the temporary cured states. Therefore, the liquid is cured before being spread on the base materials A1, A2 after being landed on the base materials A1, A2. Thus, it is possible to obtain the matched textures of mat for the cured product of the first liquid and the cured product of the second liquid.

Figure 9B:
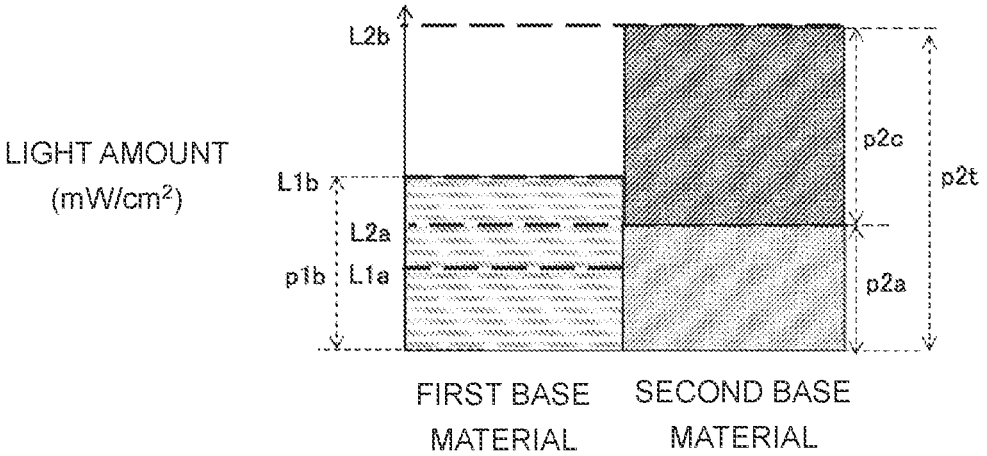

Further, in an exemplary case depicted in FIG. 9B, the maximum light amount of the light irradiator 30 is not less than the first permanent curing light amount L1*b* and the second temporary curing light amount L2*a* and less than the second permanent curing light amount L2*b*. On this account, the controller 40 acquires the first irradiation light amount on the basis of the first permanent curing light amount L1*b* in the same manner as the exemplary case depicted in FIG. 9A.

Further, the controller 40 acquires the second irradiation light amount on the basis of the second temporary curing light amount L2*a* and the second permanent curing light amount L2*b*. The second irradiation light amount includes the second temporary irradiation light amount p2*a* of the light irradiated to temporarily cure the second liquid from the uncured state by means of the irradiation of the light performed once, and the second additional (chase) irradiation light amount p2*c* of the light irradiated to permanently cure the second liquid from the temporary cured state by means of the irradiation of the light performed once. The second temporary irradiation light amount p2*a* is equal to the second temporary curing light amount L2*a*. The second additional irradiation light amount p2*c* is set so that the totalized light amount p2*t*, which is the sum of the second additional irradiation light amount p2*c* and the second temporary irradiation light amount p2*a*, is equal to the second permanent curing light amount L2*b*. Note that the second temporary irradiation light amount p2*a* may be not less than the second temporary curing light amount L2*a*. The totalized light amount p2*t* may be the light amount which is not less than the second permanent curing light amount L2*b*.

Then, in the first light irradiation process, the controller 40 executes, during the first scanning, the first permanent curing process in which the light in the first permanent irradiation light amount p1*b* is irradiated onto the first base material A1 from the following light irradiator 30, and the second temporary curing process in which the light in the second temporary irradiation light amount p2*a* is irradiated onto the second base material A2 from the following light irradiator 30. Accordingly, the first liquid is permanently cured, and the second liquid is temporarily cured. Therefore, it is possible to obtain the matched textures of mat for the cured product of the first liquid and the cured product of the second liquid.

Further, during the second scanning which follows the first scanning, the controller 40 executes the second additional curing process in which the light in the second additional irradiation light amount p2*c* is irradiated onto the second base material A2 from the following light irradiator 30. Accordingly, the second liquid, which has been temporarily cured by the irradiation of the light in the second temporary irradiation light amount p2*a* in the second temporary curing process, is permanently cured by the irradiation of the light in the second additional irradiation light amount p2*c* in the second additional curing process. In the second scanning, the light is not irradiated onto the first base material A1 from the following light irradiator 30. Therefore, it is possible to permanently cure the first liquid and the second liquid from the uncured states, while reducing the wasteful consumption of the light energy.

Note that if the maximum light amount is less than the first permanent curing light amount L1*b* and the second temporary curing light amount L2*a*, the first light irradiation process may include a process in which the first liquid is permanently cured from the uncured state by means of the irradiation performed a predetermined number of times by irradiating the light in the first irradiation light amount onto the first liquid a plurality of times, and the second liquid is temporarily cured from the uncured state by means of the irradiation performed a predetermined number of times by irradiating the light in the second irradiation light amount onto the second liquid a plurality of times. In this case, the first irradiation light amount may include a plurality of second permanent irradiation light amounts p2*b* of the light irradiated to permanently cure the first liquid from the uncured state by means of the irradiation of the light performed a plurality of times. The second irradiation light amount may include a plurality of second temporary irradiation light amounts p2*a* of the light irradiated to temporarily cure the second liquid from the uncured state by means of the irradiation of the light performed a plurality of times, and the second additional irradiation light amount p2*c* of the light irradiated to permanently cure the second liquid from the temporary cured state by means of the irradiation of the light performed once.

Further, if the maximum light amount is less than the differential light amount between the second permanent curing light amount L2*b* and the second temporary irradiation light amount p2*a*, the first light irradiation process may include a process in which the second liquid is permanently cured from the temporary cured state by irradiating the light in the second irradiation light amount a plurality of times onto the second liquid having been temporarily cured by the second temporary curing process. In this case, the second irradiation light amount may include the second temporary irradiation light amount p2*a* of the light irradiated to temporarily cure the second liquid from the uncured state by means of the irradiation of the light performed once and a plurality of second additional irradiation light amounts p2*c* of the light irradiated to permanently cure the second liquid from the temporary cured state by means of the irradiation of the light performed a plurality of times.

Fifth Modified Embodiment

In an image recording apparatus 10 according to a fifth modified embodiment, the first light irradiation process includes the first temporary curing process in which the photocurable liquid on the first base material A1 is temporarily cured from the uncured state by means of the irradiation performed a predetermined number of times by irradiating the light in the first irradiation light amount onto the first base material A1 once or a plurality of times, and the second temporary curing process in which the photocurable liquid on the second base material A2 is temporarily cured from the uncured state by means of the irradiation performed a predetermined number of times by irradiating the light in the second irradiation light amount onto the second base material A2 a predetermined number of times.

The first light irradiation process includes a process in which the photocurable liquid is permanently cured from the temporary cured state by irradiating the light in the first irradiation light amount once or a plurality of times onto the photocurable liquid on the first base material A1 having been temporarily cured by the first temporary curing process, and a process in which the photocurable liquid is permanently cured from the temporary cured state by irradiating the light in the second irradiation light amount once or a plurality of times onto the photocurable liquid on the second base material A2 having been temporarily cured by the second temporary curing process.

In exemplary cases depicted in FIGS. 10A to 11B, in the curing light amount acquiring process, the controller 40 acquires the first temporary curing light amount L1*a*, the first permanent curing light amount L1*b*, the second temporary curing light amount L2*a*, and the second permanent curing light amount L2*b*. Then, in the irradiation light amount acquiring process, the controller 40 compares the maximum light amount of the light capable of being irradiated from the light irradiator 30 with the respective curing light amounts. In the exemplary cases depicted in FIGS. 10A and 10B, the maximum light amount of the light irradiator 30 is not less than the first temporary curing light amount L1*a* and the second temporary curing light amount L2*a* and less than the first permanent curing light amount L1*b*. In the exemplary cases depicted in FIGS. 11A and 11B, the maximum light amount of the light irradiator 30 is less than the first temporary curing light amount L1*a* and the second temporary curing light amount L2*a*.

Then, the controller 40 acquires the first irradiation light amount and the second irradiation light amount on the basis of the respective curing light amounts and the maximum light amount. In this procedure, the controller 40 acquires the first irradiation light amount and the second irradiation light amount so that the first liquid and the second liquid are temporarily cured from the uncured states during the identical scanning, and the first liquid and the second liquid are permanently cured from the temporary cured states by means of the irradiation of the light performed once or a plurality of times.

Figure 10A:
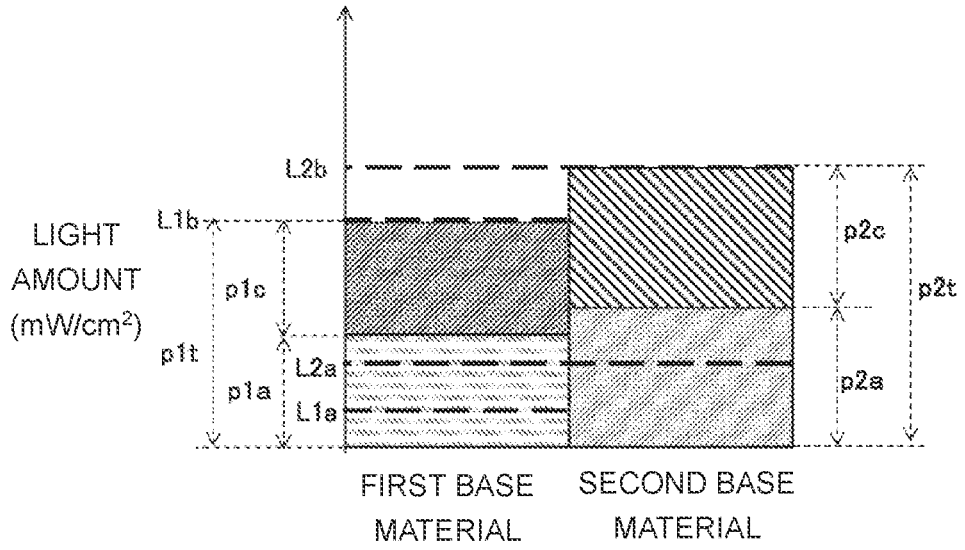
FIGS. 10A and 10B depict graphs illustrating the light amounts for respective base materials in relation to an image recording apparatus according to a fifth modified embodiment of the present teaching.

In the exemplary case depicted in FIG. 10A, the first irradiation light amount includes the first temporary irradiation light amount p1*a* of the light irradiated to temporarily cure the first liquid from the uncured state by means of the irradiation of the light performed once, and the first additional irradiation light amount p1*c* of the light irradiated to permanently cure the first liquid from the temporary cured state by means of the irradiation of the light performed once. Further, the second irradiation light amount includes the second temporary irradiation light amount p2*a* of the light irradiated to temporarily cure the second liquid from the uncured state by means of the irradiation of the light performed once, and the second additional irradiation light amount p2*c* of the light irradiated to permanently cure the second liquid from the temporary cured state by means of the irradiation of the light performed once.

The first temporary irradiation light amount p1*a* and the second temporary irradiation light amount p2*a* are not less than the higher light amount of the first temporary curing light amount L1*a* and the second temporary curing light amount L2*a*. The first temporary irradiation light amount p1*a* and the second temporary irradiation light amount p2*a* may be equal to one another or different from each other. Further, the first additional irradiation light amount p1*c* is set so that the totalized light amount p1*t* of the first additional irradiation light amount p1*c* and the first temporary irradiation light amount p1*a* is equal to the first permanent curing light amount L1*b*. The second additional irradiation light amount p2*c* is set so that the totalized light amount p2*t* of the second additional irradiation light amount p2*c* and the second temporary irradiation light amount p2*a* is equal to the second permanent curing light amount L2*b*. Note that the totalized light amount p1*t* may be the light amount which is not less than the first permanent curing light amount L1*b*, and the totalized light amount p2*t* may be the light amount which is not less than the second permanent curing light amount L2*b*.

Then, in the first light irradiation process, the controller 40 executes, during the first scanning, a first temporary curing process in which the light in the first temporary irradiation light amount p1*a* is irradiated onto the first base material A1 from the following light irradiator 30, and a second temporary curing process in which the light in the second temporary irradiation light amount p2*a* is irradiated onto the second base material A2 from the following light irradiator 30. Accordingly, the first liquid and the second liquid are temporarily cured from the uncured states. As described above, the first liquid and the second liquid are temporarily cured during the identical first scanning. Therefore, it is possible to obtain the matched textures of mat for the cured products obtained by curing the liquids.

Further, the controller 40 executes, during the second scanning, a first additional curing process in which the light in the first additional irradiation light amount p1*c* is irradiated onto the first base material A1 from the following light irradiator 30, and a second additional curing process in which the light in the second additional irradiation light amount p2*c* is irradiated onto the second base material A2 from the following light irradiator 30. Accordingly, the first liquid, which has been temporarily cured by the irradiation of the light in the first temporary irradiation light amount p1*a* in the first temporary curing process, is permanently cured by the irradiation of the light in the first additional irradiation light amount p1*c* in the first additional curing process. The second liquid, which has been temporarily cured by the irradiation of the light in the second temporary irradiation light amount p2*a* in the second temporary curing process, is permanently cured by the irradiation of the light in the second additional irradiation light amount p2*c* in the second additional curing process. On this account, it is possible to permanently cure the first liquid and the second liquid, while reducing the wasteful consumption of the light energy.

Figure 10B:
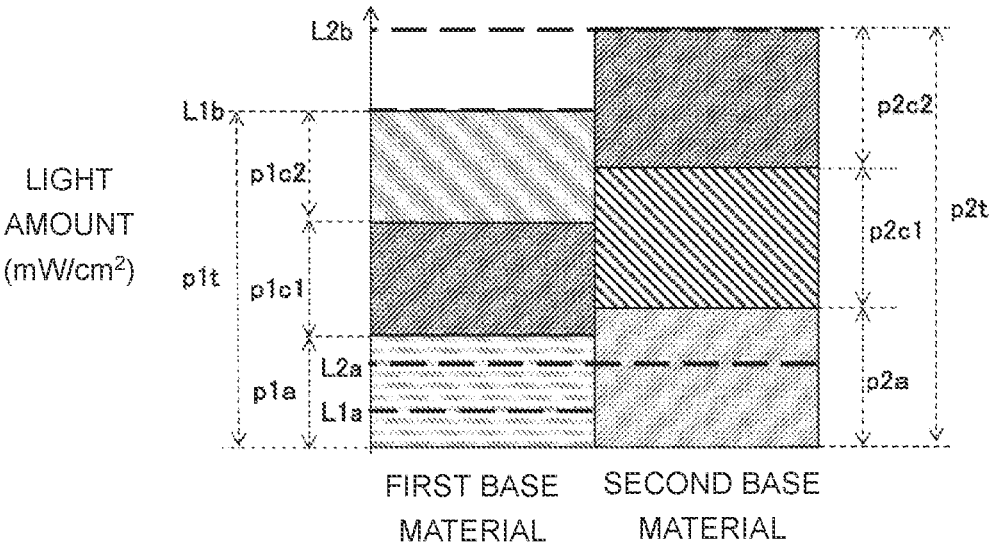

Note that as depicted in FIG. 10B, if the maximum light amount is less than the differential light amount between the first permanent curing light amount L1*b* and the first temporary irradiation light amount p1*a*, the controller 40 may permanently cure the first liquid from the temporary cured state by irradiating the light in the first additional irradiation light amount a plurality of times onto the first liquid having been temporarily cured by the first temporary curing process, in the first additional curing process of the first light irradiation process.

In this case, the first irradiation light amount includes the first temporary irradiation light amount p1*a* of the light irradiated to temporarily cure the first liquid from the uncured state by means of the irradiation of the light performed once, and a plurality of first additional irradiation light amounts p1*c*1, p1*c*2 of the light irradiated to permanently cure the first liquid from the temporary cured state by means of the irradiation of the light performed a plurality of times. The totalized light amount p1*t* of the first temporary irradiation light amount p1*a*, the first additional irradiation light amount p1*c*1, and the first additional irradiation light amount p1*c*2 is equal to the first permanent curing light amount L1*b*. Note that the totalized light amount p1*t* may be the light amount which is not less than the first permanent curing light amount L1*b*.

Further, as depicted in FIG. 10B, if the maximum light amount is less than the differential light amount between the second permanent curing light amount L2*b* and the second temporary irradiation light amount p2*a*, the controller 40 may permanently cure the second liquid from the temporary cured state by irradiating the light in the second additional irradiation light amount a plurality of times onto the second liquid having been temporarily cured by the second temporary curing process, in the second additional curing process of the first light irradiation process.

In this case, the second irradiation light amount includes the second temporary irradiation light amount p2*a* of the light irradiated to temporarily cure the second liquid from the uncured state by means of the irradiation of the light performed once, and a plurality of second additional irradiation light amounts p2*c*1, p2*c*2 of the light irradiated to permanently cure the second liquid from the temporary cured state by means of the irradiation of the light performed a plurality of times. The totalized light amount p2*t* of the second temporary irradiation light amount p2*a*, the second additional irradiation light amount p2*c*1, and the second additional irradiation light amount p2*c*2 is equal to the second permanent curing light amount L2*b*. Note that the totalized light amount p2*t* may be the light amount which is not less than the second permanent curing light amount L2*b*.

In this procedure, the number of times of irradiation of the light in the first additional irradiation light amount is set to be the minimum number of times at which the totalized light amount p1*t* is not less than the first permanent curing light amount L1*b*. Further, the number of times of irradiation of the light in the second additional irradiation light amount is set to be the minimum number of times at which the totalized light amount p2*t* is not less than the second permanent curing light amount L2*b*. Note that the number of times of irradiation of the light in the first additional irradiation light amount and the number of times of irradiation of the light in the second additional irradiation light amount may be identical with each other or different from each other.

Then, in the first light irradiation process, the controller 40 irradiates, during the first scanning, the light in the first temporary irradiation light amount p1*a* onto the first base material A1 from the following light irradiator 30, and the controller 40 irradiates the light in the second temporary irradiation light amount onto the second base material A2 from the following light irradiator 30. Accordingly, the first liquid and the second liquid are temporarily cured during the identical first scanning. On this account, it is possible to obtain the matched textures of mat for the cured products obtained by curing the liquids.

Further, during the second scanning, the controller 40 irradiates the light in the first additional irradiation light amount p1*c*1 onto the first base material A1 from the following light irradiator 30, and the controller 40 irradiates the light in the second additional irradiation light amount p2*c*1 onto the second base material A2 from the following light irradiator 30. Subsequently, during the third scanning, the controller 40 irradiates the light in the first additional irradiation light amount p1*c*2 onto the first base material A1 from the following light irradiator 30, and the controller 40 irradiates the light in the second additional irradiation light amount p2*c*2 onto the second base material A2 from the following light irradiator 30. Accordingly, the first liquid and the second liquid are permanently cured from the temporary cured states. On this account, it is possible to permanently cure the first liquid and the second liquid, while reducing the wasteful consumption of the light energy.

Figure 11A:
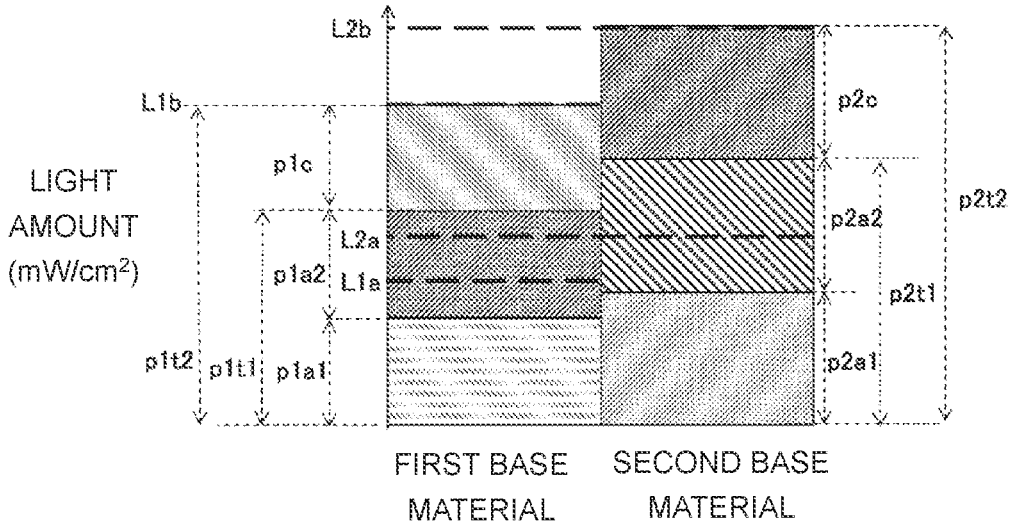
FIGS. 11A and 11B depict graphs illustrating the light amounts for respective base materials in relation to an image recording apparatus according to a sixth modified embodiment of the present teaching.

In an exemplary case depicted in FIG. 11A, the first irradiation light amount includes a plurality of first temporary irradiation light amounts p1*a*1, p1*a*2 of the light irradiated to temporarily cure the first liquid from the uncured state by means of the irradiation of the light performed a plurality of times, and the first additional irradiation light amount p1*c* of the light irradiated to permanently cure the first liquid from the temporary cured state by means of the irradiation of the light performed once. The second irradiation light amount includes second temporary irradiation light amounts p2*a*1, p2*a*2 of the light irradiated to temporarily cure the second liquid from the uncured state by means of the irradiation of the light performed a plurality of times, and the second additional irradiation light amount p2*c* of the light irradiated to permanently cure the second liquid from the temporary cured state by means of the irradiation of the light performed once.

The first temporary irradiation light amounts p1*a*1, p1*a*2 are set so that the first temporary curing light amount L1*a* and the second temporary curing light amount L2*a* are larger than the first temporary irradiation light amount p1*a*1, and the first temporary curing light amount L1*a* and the second temporary curing light amount L2*a* are not more than the totalized light amount p1*t*1 of the first temporary irradiation light amount p1*a*1 and the first temporary irradiation light amount p1*a*2. The first temporary irradiation light amount p1*a*1 and the first temporary irradiation light amount p1*a*2 may be equal to one another or different from each other. The first additional irradiation light amount p1*c* is set so that the totalized light amount p1*t*2 of the first additional irradiation light amount p1*c* and the first temporary irradiation light amounts p1*a*1, p1*a*2 is equal to the first permanent curing light amount L1*b*. Note that the totalized light amount p1*t*2 may be the light amount which is not less than the first permanent curing light amount L1*b*.

The second temporary irradiation light amount p2*a*1 is the light amount of the light irradiated prior to the second temporary irradiation light amount p2*a*. The second temporary irradiation light amounts p2*a*1, p2*a*2 are set so that the first temporary curing light amount L1*a* and the second temporary curing light amount L2*a* are larger than the second temporary irradiation light amount p2*a*1, and the first temporary curing light amount L1*a* and the second temporary curing light amount L2*a* are not more than the totalized light amount p2*t*1 of the second temporary irradiation light amount p2*a*1 and the second temporary irradiation light amount p2*a*2. The second temporary irradiation light amount p2*a*1 and the second temporary irradiation light amount p2*a*2 may be equal to one another or different from each other. The second additional irradiation light amount p2*c* is set so that the totalized light amount p2*t*2 of the second additional irradiation light amount p2*c* and the second temporary irradiation light amounts p2*a*1, p2*a*2 is equal to the second permanent curing light amount L2*b*. Note that the totalized light amount p2*t*2 may be the light amount which is not less than the second permanent curing light amount L2*b*.

Then, in the first light irradiation process, the controller 40 executes the first temporary curing process, the first additional curing process, the second temporary curing process, and the second additional curing process. In the exemplary case depicted in FIG. 11A, the controller 40 temporarily cures, in the first temporary curing process, the first liquid from the uncured state by means of the irradiation performed twice by irradiating the light in the first irradiation light amount onto the first base material A1 twice. The controller 40 permanently cures, in the first additional curing process, the first liquid from the temporary cured state by irradiating the light in the first irradiation light amount once onto the first liquid having been temporarily cured by the first temporary curing process. The controller 40 temporarily cures, in the second temporary curing process, the second liquid from the uncured state by means of the irradiation performed twice by irradiating the light in the second irradiation light amount onto the second base material A2 twice. The controller 40 permanently cures, in the second additional curing process, the second liquid from the temporary cured state by irradiating the light in the second irradiation light amount once onto the second liquid having been temporarily cured by the second temporary curing process.

On this account, during the first scanning, the controller 40 executes the first temporary curing process in which the light in the first temporary irradiation light amount p1*a*1 is irradiated onto the first base material A1 from the following light irradiator 30, and the second temporary curing process in which the light in the second temporary irradiation light amount p2*a*1 is irradiated onto the second base material A2 from the following light irradiator 30. Further, during the second scanning, the controller 40 executes the first temporary curing process in which the light in the first temporary irradiation light amount p1*a*2 is irradiated onto the first base material A1 from the following light irradiator 30, and the second temporary curing process in which the light in the second temporary irradiation light amount p2*a*2 is irradiated onto the second base material A2 from the following light irradiator 30.

Accordingly, the light in the totalized light amount p1*t*1 is irradiated onto the first liquid, and the first liquid is temporarily cured from the uncured state. The light in the totalized light amount p2*t*1 is irradiated onto the second liquid, and the second liquid is temporarily cured from the uncured state. As described above, the first liquid and the second liquid are temporarily cured during the identical second scanning. Therefore, it is possible to obtain the matched textures of the cured products obtained by curing the liquids.

Further, during the third scanning, the controller 40 executes the first additional curing process in which the light in the first additional irradiation light amount p1*c* is irradiated onto the first base material A1 from the following light irradiator 30, and the second additional curing process in which the light in the second additional irradiation light amount p2*c* is irradiated onto the second base material A2 from the following light irradiator 30. Accordingly, the first liquid, which has been temporarily cured by the light in the totalized light amount p1*t*1, is permanently cured by the irradiation of the light in the first additional irradiation light amount p1*c*. The second liquid, which has been temporarily cured by the irradiation of the light in the totalized light amount p2*t*1, is permanently cured by the irradiation of the light in the second additional irradiation light amount p2*c*. Therefore, it is possible to permanently cure the first liquid and the second liquid, while reducing the wasteful consumption of the light energy.

Note that if the first temporary curing light amount L1*a* is lower than the second temporary curing light amount L2*a*, the second temporary irradiation light amount p2*a*1 is made to be lower than the first temporary curing light amount L1*a*. Accordingly, for example, even if the light in the second temporary irradiation light amount p2*a*1 leaks during the first scanning, and the light is irradiated onto the first base material A1, then it is possible to suppress the first liquid from being temporarily cured. Therefore, it is possible to temporarily cure the first liquid and the second liquid during the identical second scanning, and it is possible to obtain the matched textures of the cured products.

Figure 11B:
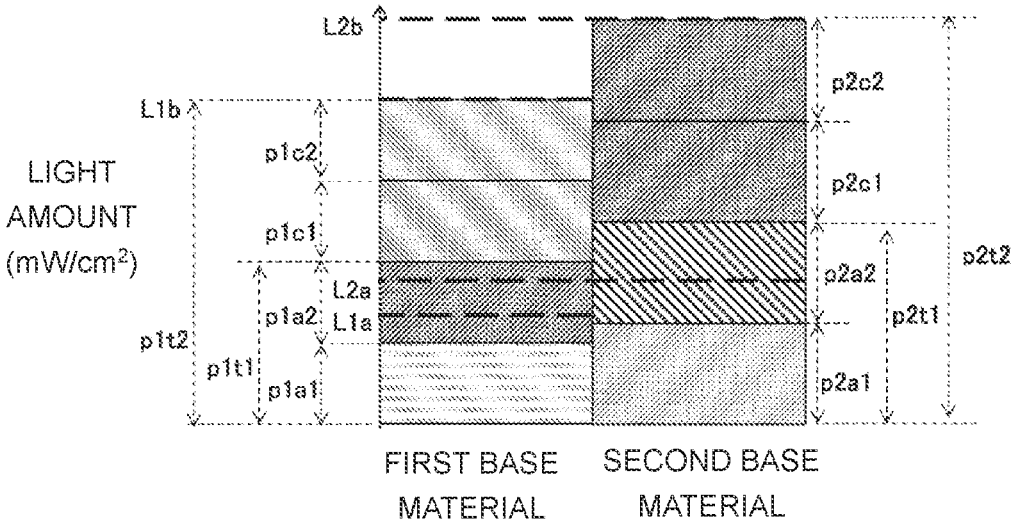

Further, if the maximum light amount is less than the differential light amount between the first permanent curing light amount L1*b* and the totalized light amount p1*t*1, as depicted in FIG. 11B, the controller 40 may permanently cure the first liquid from the temporary cured state by irradiating, in the first additional curing process of the first light irradiation process, the light in the first additional irradiation light amount a plurality of times onto the first liquid having been temporarily cured by the first temporary curing process.

In this case, the first irradiation light amount includes the first temporary irradiation light amounts p1*a*1, p1*a*2 of the light irradiated to temporarily cure the first liquid from the uncured state by means of the irradiation of the light performed a plurality of times, and a plurality of the first additional irradiation light amounts p1*c*1, p1*c*2 of the light irradiated to permanently cure the first liquid from the temporary cured state by means of the irradiation of the light performed a plurality of times. The totalized light amount p1*t*2 of the first temporary irradiation light amount p1*a*1, the first temporary irradiation light amount p1*a*2, the first additional irradiation light amount p1*c*1, and the first additional irradiation light amount p1*c*2 is equal to the first permanent curing light amount L1*b*. Note that the totalized light amount p1*t*2 may be the light amount which is not less than the first permanent curing light amount L1*b*.

Further, if the maximum light amount is less than the differential light amount between the second permanent curing light amount L2*b* and the totalized light amount p2*t*1, as depicted in FIG. 11B, the controller 40 may permanently cure the second liquid from the temporary cured state by irradiating, in the second additional curing process of the first light irradiation process, the light in the second additional irradiation light amount a plurality of times onto the second liquid having been temporarily cured by the second temporary curing process.

In this case, the second irradiation light amount includes the second temporary irradiation light amounts p2*a*1, p2*a*2 of the light irradiated to temporarily cure the second liquid from the uncured state by means of the irradiation of the light performed a plurality of times, and a plurality of the second additional irradiation light amounts p2*c*1, p2*c*2 of the light irradiated to permanently cure the second liquid from the temporary cured state by means of the irradiation of the light performed a plurality of times. The totalized light amount p2*t*2 of the second temporary irradiation light amount p2*a*1, the second temporary irradiation light amount p2*a*2, the second additional irradiation light amount p2*c*1, and the second additional irradiation light amount p2*c*2 is equal to the second permanent curing light amount L2*b*. Note that the totalized light amount p2*t*2 may be the light amount which is not less than the second permanent curing light amount L2*b*.

Second Embodiment

In an image recording apparatus 10 according to a second embodiment of the present teaching, the controller 40 executes a data acquiring process, an information acquiring process, a curing light amount acquiring process, a first subtracting process, a irradiation light amount acquiring process, a recording process, a second light irradiation process, and a third light irradiation process.

In the data acquiring process, the controller 40 acquires the discharge data in order to discharge the photocurable liquid from the head 20. In the recording process, the photocurable liquid is discharged to the first base material A1 and the second base material A2 on the basis of the discharge data, while relatively moving the recording medium A and the head 20. In the information acquiring process, the first position information of the first base material A1 and the second position information of the second base material A2 are acquired.

In the curing light amount acquiring process, the controller 40 acquires the first permanent curing light amount which is required to permanently cure the photocurable liquid on the first base material A1 from the uncured state, and the second permanent curing light amount which is higher than the first permanent curing light amount and which is required to permanently cure the photocurable liquid on the second base material A2 from the uncured state. Each of the first permanent curing light amount and the second permanent curing light amount is any one of the irradiation illuminance and the integrated light amount.

In the first subtracting process, the controller 40 acquires the first differential light amount obtained by subtracting the first permanent curing light amount L1*b* from the second permanent curing light amount L2*b*. In the second light irradiation process, the controller 40 irradiates the light in the third irradiation light amount corresponding to the first permanent curing light amount onto the first base material A1 and the second base material A2 on the basis of the first position information and the second position information, while relatively moving the recording medium A and the light irradiator 30. In the third light irradiation process, the controller 40 irradiates the light in the fourth irradiation light amount corresponding to the first differential light amount onto the second base material A2 on the basis of the second position information, while relatively moving the recording medium A and the light irradiator 30. Each of the third irradiation light amount and the fourth irradiation light amount is any one of the irradiation illuminance and the integrated light amount.

Figure 12:
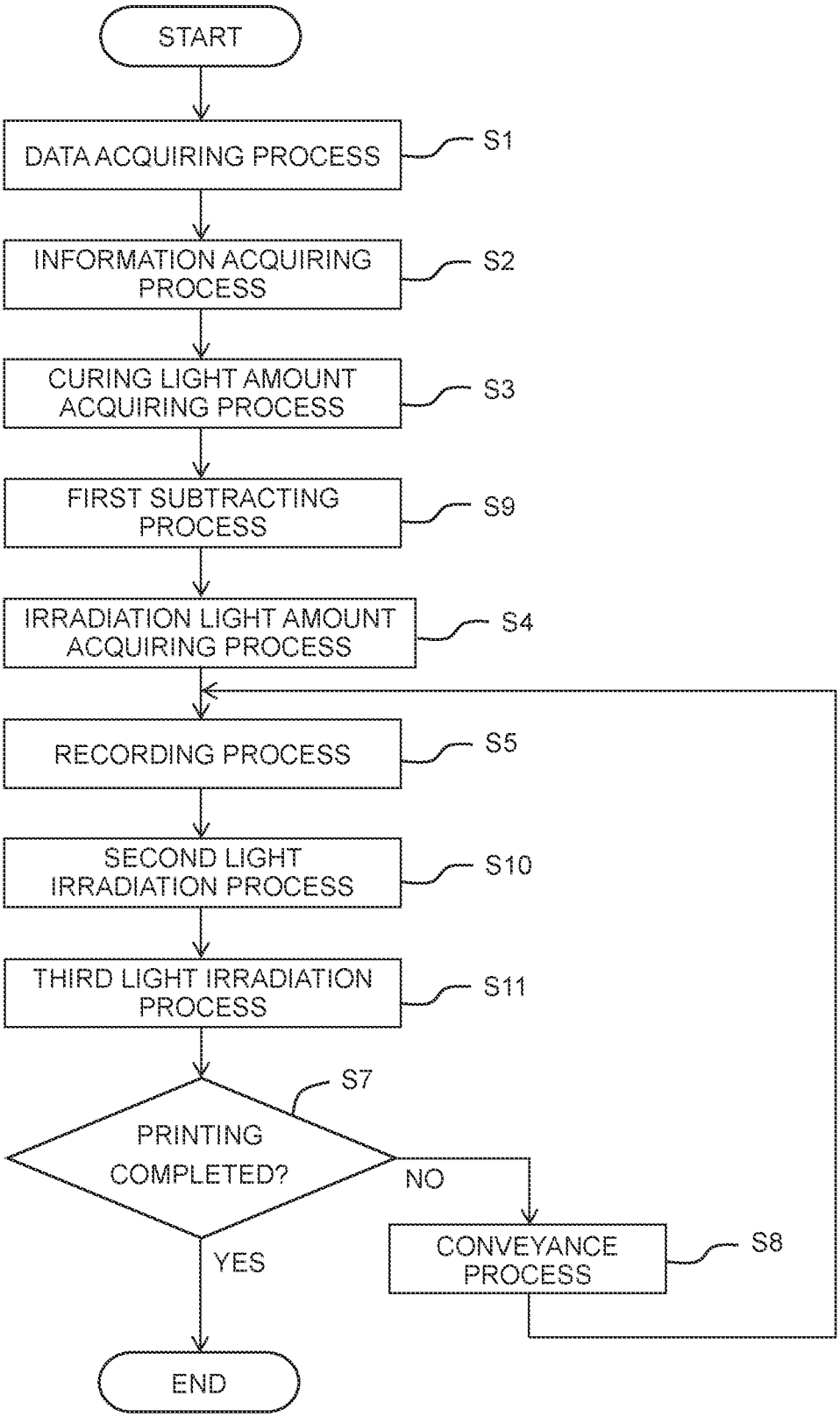
FIG. 12 depicts a flow chart illustrating an exemplary control method for an image recording apparatus according to a second embodiment of the present teaching.

For example, a control method for the image recording apparatus 10 is executed by the controller 40 in accordance with a flow chart depicted in FIG. 12. In the flow chart depicted in FIG. 12, the first subtracting process of Step S9 is executed between the curing light amount acquiring process of Step S3 and the irradiation light amount acquiring process of Step S4 depicted in FIG. 5. Further, in the flow chart depicted in FIG. 12, the second light irradiation process of Step S10 and the third light irradiation process of Step S11 are executed in place of the first light irradiation process of Step S6 depicted in FIG. 5.

Figure 13A:
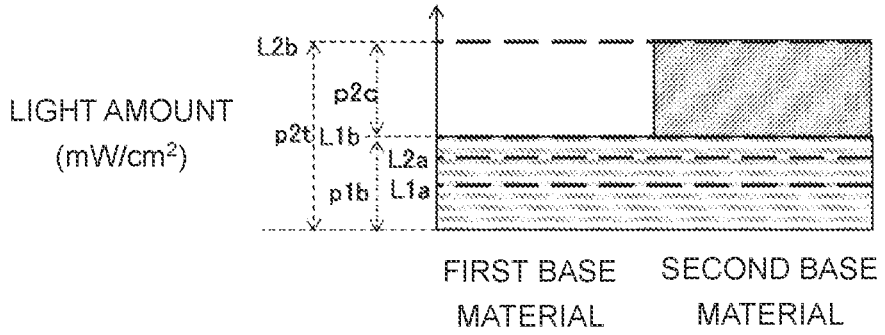
FIGS. 13A and 13B depict graphs illustrating the light amounts for respective base materials in relation to the image recording apparatus depicted in FIG. 12.

In an exemplary case depicted in FIG. 13A, the second light irradiation process includes the process in which the photocurable liquid on the first base material A1 is permanently cured from the uncured state, and the photocurable liquid on the second base material A2 is temporarily cured from the uncured state by irradiating the light in the third irradiation amount once onto the first base material A1 and the second base material A2.

Specifically, the controller 40 compares the maximum light amount of the light capable of being irradiated from the light irradiator 30 with the respective curing light amounts in the irradiation light amount acquiring process. In this procedure, the maximum light amount of the light irradiator 30 is not less than the first permanent curing light amount L1*b* and less than the second permanent curing light amount L2*b*. Then, the controller 40 acquires the third irradiation light amount and the fourth irradiation light amount on the basis of the respective curing light amounts and the maximum light amount.

The third irradiation light amount includes the first permanent irradiation light amount p1*b* irradiated to permanently cure the first liquid from the uncured state by means of the irradiation of the light performed once. The first permanent irradiation light amount p1*b* is equal to the first permanent curing light amount L1*b*. In this procedure, the first permanent curing light amount L1*b* is higher than the second temporary curing light amount L2*a*. Therefore, the second liquid is temporarily cured from the uncured state by irradiating the light in the first permanent irradiation light amount p1*b* onto the second liquid once. Note that the first permanent irradiation light amount p1*b* may be the light amount which is not less than the first permanent curing light amount L1*b* and less than the second permanent curing light amount L2*b*.

The fourth irradiation light amount includes the second additional irradiation light amount p2*c* irradiated to permanently cure the second liquid from the temporary cured state by means of the irradiation of the light performed once. The second additional irradiation light amount p2*c* is equal to the first differential light amount which is the difference between the second permanent curing light amount L2*b* and the first permanent curing light amount L1*b*. The totalized light amount p2*t* of the second additional irradiation light amount p2*c* and the first permanent irradiation light amount p1*b* is equal to the second permanent curing light amount L2*b*. Note that the second additional irradiation light amount p2*c* may be the light amount which is not less than the first differential light amount, and the totalized light amount p2*t* may be the light amount which is not less than the first permanent curing light amount L1*b*.

Then, in the second light irradiation process, the controller 40 irradiates, during the first scanning, the light in the first permanent irradiation light amount p1*b* from the following light irradiator 30 onto the first base material A1 and the second base material A2. Accordingly, the first liquid is permanently cured from the uncured state, and the second liquid is temporarily cured from the uncured state. As described above, the first liquid and the second liquid are cured during the identical first scanning. Therefore, it is possible to obtain the matched textures of mat for the cured products obtained by curing the liquids.

Further, in the third light irradiation process, the controller 40 irradiates, during the second scanning, the light in the second additional irradiation light amount p2*c* from the following light irradiator 30 onto the second base material A2. Accordingly, the second liquid, which has been temporarily cured by the irradiation of the light in the first permanent irradiation light amount p1*b* in the second light irradiation process, is permanently cured by the irradiation of the light in the second additional irradiation light amount p2*c* in the third light irradiation process. During the second scanning, the light is not irradiated onto the first base material A1 from the following light irradiator 30. Therefore, it is possible to permanently cure the first liquid and the second liquid from the uncured states, while reducing the wasteful consumption of the light energy.

Note that if the maximum light amount is less than the first differential light amount, the third light irradiation process may include the process in which the second liquid is permanently cured from the temporary cured state by irradiating the light in the fourth irradiation light amount a plurality of times onto the second liquid having been temporarily cured by the second light irradiation process. In this case, the fourth irradiation light amount may include a plurality of irradiation light amounts of the light irradiated to permanently core the second liquid from the temporary cured state by means of the irradiation of the light performed a plurality of times.

Figure 13B:
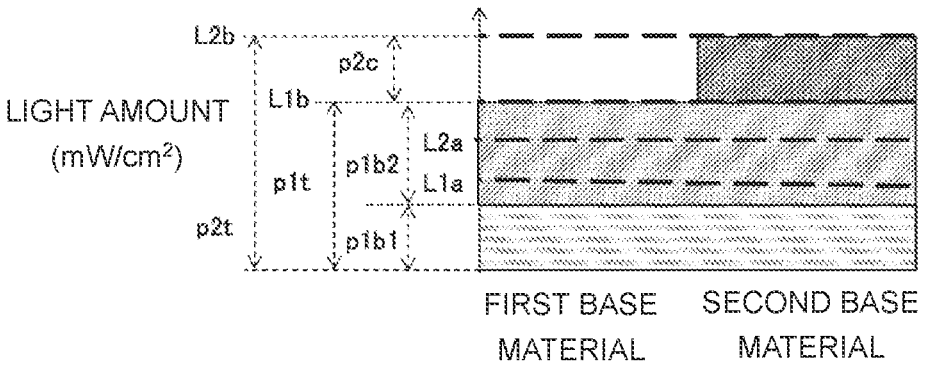

In an exemplary case depicted in FIG. 13B, the second light irradiation process includes the process in which the photocurable liquid on the first base material A1 is permanently cured from the uncured state by means of the irradiation performed a predetermined number of times, and the photocurable liquid on the second base material A2 is temporarily cured from the uncured state by means of the irradiation performed a predetermined number of times, by irradiating the light in the third irradiation light amount a plurality of times onto the first base material A1 and the second base material A2.

Specifically, the controller 40 compares, in the irradiation light amount acquiring process, the maximum light amount of the light capable of being irradiated from the light irradiator 30 with the respective curing light amounts. In this procedure, the maximum light amount of the light irradiator 30 is less than the first temporary curing light amount L1*a* and the second temporary curing light amount L2*a* and not less than the first differential light amount. The third irradiation light amount and the fourth irradiation light amount are acquired on the basis of the respective curing light amounts and the maximum light amount. Note that the fourth irradiation light amount depicted in FIG. 13B is the same as or equivalent to the fourth irradiation light amount depicted in FIG. 13A except that the totalized light amount p2*t* of the second additional irradiation light amount p2*c* and the totalized light amount p1*t* is equal to the second permanent curing light amount L2*b*.

The third irradiation light amount includes a plurality of first permanent irradiation light amounts p1*b*1, p1*b*2 which are required to permanently cure the first liquid from the uncured state by means of the irradiation of the light performed a plurality of times (for example, twice). The totalized light amount p1*t* of the first permanent irradiation light amount p1*b*1 and the first permanent irradiation light amount p1*b*2 is equal to the first permanent curing light amount L1*b*. Further, the first permanent irradiation light amounts p1*b*1, p1*b*2 are set so that both of the first liquid and the second liquid are temporarily cured from the uncured states by means of the irradiation of the light performed a predetermined number of times (for example, twice). In this exemplary case, the first permanent irradiation light amounts p1*b*1, p1*b*2 are set so that the first temporary curing light amount L1*a* and the second temporary curing light amount L2*a* are higher than the first permanent irradiation light amount p1*b*1, and the first temporary curing light amount L1*a* and the second temporary curing light amount L2*a* are not more than the totalized light amount p1*t*. Note that, the totalized light amount p1*t* may be the light amount which is not less than the first permanent curing light amount L1*b*.

Then, in the second light irradiation process, the controller 40 irradiates, during the first scanning, the light in the first permanent irradiation light amount p1*b*1 from the following light irradiator 30 onto the first base material A1 and the second base material A2. The first permanent irradiation light amount p1*b*1 is less than the first temporary curing light amount L1*a* and the second temporary curing light amount L2*a*. Therefore, the first liquid and the second liquid are not temporarily cured, and the first liquid and the second liquid remain in the uncured states.

Subsequently, the controller 40 irradiates, during the second scanning, the light in the first permanent irradiation light amount p1*b*2 from the following light irradiator 30 onto the first base material A1 and the second base material A2. Accordingly, the totalized light amount p1*t*, which is irradiated onto the first liquid, exceeds the first temporary curing light amount L1*a* and arrives at the first permanent curing light amount L1*b*. The first liquid is permanently cured from the uncured state via the temporary cured state. Further, the totalized light amount p1*t*, which is irradiated onto the second liquid, arrives at the second temporary curing light amount L2*a*. The second liquid is temporarily cured from the uncured state. In this way, the first liquid and the second liquid are temporarily cured during the identical second scanning. Therefore, it is possible to obtain the matched textures of gloss for the cured products obtained by curing the liquids.

Then, in the third light irradiation process, the controller 40 irradiates the light in the second additional irradiation light amount p2*c* from the following light irradiator 30 onto the second base material A2 during the third scanning. Accordingly, the second liquid, which has been temporarily cured by the irradiation of the light in the totalized light amount p1*t* in the second light irradiation process, is permanently cured by the irradiation of the light in the second additional irradiation light amount p2*c* in the third light irradiation process. During the third scanning, the light is not irradiated from the following light irradiator 30 onto the first base material A1. Therefore, it is possible to permanently cure the first liquid and the second liquid from the uncured states, while reducing the wasteful consumption of the light energy.

Figure 14A:
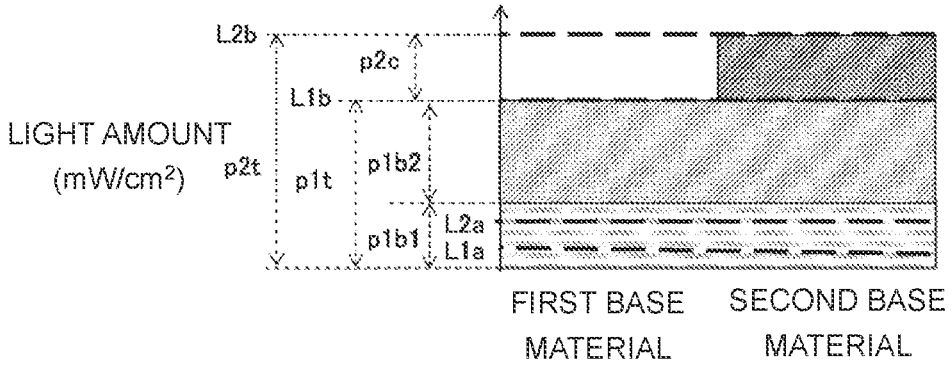
FIGS. 14A and 14B depict graphs illustrating the light amounts for respective base materials in relation to the image recording apparatus depicted in FIG. 12.

In an exemplary case depicted in FIG. 14A, the second light irradiation process includes the process in which the photocurable liquid on the first base material A1 and the photocurable liquid on the second base material A2 are temporarily cured from the uncured states by irradiating the light in the third irradiation light amount once onto the first base material A1 and the second base material A2.

Specifically, the controller 40 compares, in the irradiation light amount acquiring process, the maximum light amount of the light capable of being irradiated from the light irradiator 30 with the respective curing light amounts. In this procedure, the maximum light amount of the light irradiator 30 is not less than the first temporary curing light amount L1*a*, the second temporary curing light amount L2*a*, and the first differential light amount and less than the first permanent curing light amount L1*b*. The third irradiation light amount and the fourth irradiation light amount are acquired on the basis of the respective curing light amounts and the maximum light amount.

The third irradiation light amount depicted in FIG. 14A is the same as or equivalent to the third irradiation light amount depicted in FIG. 13B except that the first permanent irradiation light amount p1*b*1 is not less than the first temporary curing light amount L1*a* and the second temporary curing light amount L2*a*. Further, the fourth irradiation light amount depicted in FIG. 14A is the same as or equivalent to the fourth irradiation light amount depicted in FIG. 13B.

Then, in the second light irradiation process, the controller 40 irradiates, during the first scanning, the light in the first permanent irradiation light amount p1*b*1 from the following light irradiator 30 onto the first base material A1 and the second base material A2. The first permanent irradiation light amount p1*b*1 is not less than the first temporary curing light amount L1*a* and the second temporary curing light amount L2*a*. Therefore, the first liquid and the second liquid are temporarily cured from the uncured states. In this way, the first liquid and the second liquid are temporarily cured during the identical first scanning. Therefore, it is possible to obtain the matched textures of mat for the cured products obtained by curing the liquids.

Subsequently, the controller 40 irradiates, during the second scanning, the light in the first permanent irradiation light amount p1*b*2 from the following light irradiator 30 onto the first base material A1 and the second base material A2. Accordingly, the totalized light amount p1*t*, which has been irradiated onto the first liquid, arrives at the first permanent curing light amount L1*b*. The first liquid is permanently cured from the temporary cured state. Further, the totalized light amount p1*t*, which has been irradiated onto the second liquid, does not arrive at the second permanent curing light amount L2*b*. The second liquid maintains the temporary cured state.

Then, in the third light irradiation process, the controller 40 irradiates, during the third scanning, the light in the second additional irradiation light amount p2*c* from the following light irradiator 30 onto the second base material A2. Accordingly, the second liquid, which has been temporarily cured by the irradiation of the light in the totalized light amount p1*t* in the second light irradiation process, is permanently cured by the irradiation of the light in the second additional irradiation light amount p2*c* in the third light irradiation process. During the third scanning, the light is not irradiated from the following light irradiator 30 onto the first base material A1. Therefore, it is possible permanently cure the first liquid and the second liquid from the uncured states, while reducing the wasteful consumption of the light energy.

Figure 14B:
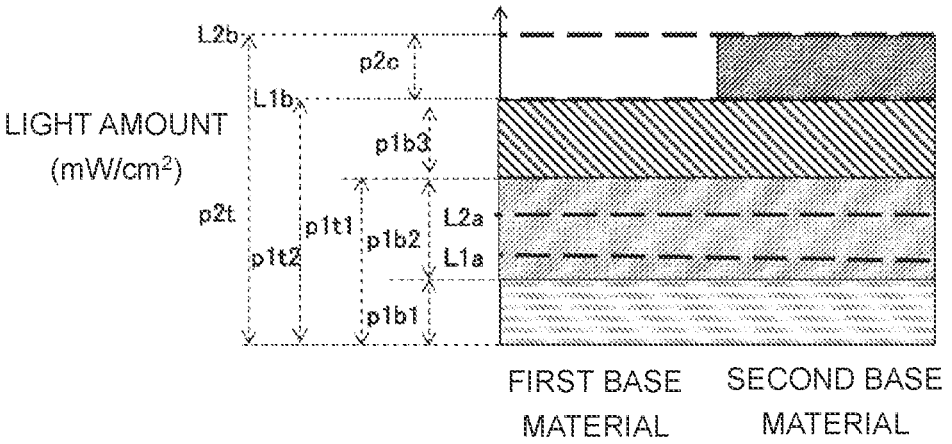

In an exemplary case depicted in FIG. 14B, the second light irradiation process includes the process in which the photocurable liquid on the first base material A1 and the photocurable liquid on the second base material A2 are temporarily cured from the uncured states by means of the irradiation performed a predetermined number of times, by irradiating the light in the third irradiation light amount a plurality of times onto the first base material A1 and the second base material A2.

Specifically, the controller 40 compares, in the irradiation light amount acquiring process, the maximum light amount of the light capable of being irradiated from the light irradiator 30 with the respective curing light amounts. In this procedure, the maximum light amount of the light irradiator 30 is less than the first temporarily curing light amount L1*a* and the second temporary curing light amount L2*a* and not less than the first differential light amount. The third irradiation light amount and the fourth irradiation light amount are acquired on the basis of the respective curing light amounts and the maximum light amount. Note that the fourth irradiation light amount depicted in FIG. 14B is the same as or equivalent to the fourth irradiation light amount depicted in FIG. 13B.

The third irradiation light amount includes a plurality of first permanent irradiation light amounts p1*b*1, p1*b*2, p1*b*3 which are required to permanently cure the first liquid from the uncured state by means of the irradiation of the light performed a plurality of times (for example, three times). The totalized light amount p1*t*2 of the first permanent irradiation light amount p1*b*1, the first permanent irradiation light amount p1*b*2, and the first permanent irradiation light amount p1*b*3 is equal to the first permanent curing light amount L1*b*. Further, the first permanent irradiation light amounts p1*b*1, p1*b*2 are set so that both of the first liquid and the second liquid are temporarily cured from the uncured states by means of the irradiation of the light performed a predetermined number of times (for example, twice). In this exemplary case, the first permanent irradiation light amounts p1*b*1, p1*b*2 are set so that the first temporary curing light amount L1*a* and the second temporary curing light amount L2*a* are higher than the first permanent irradiation light amount p1*b*1 and not more than the totalized light amount p1*t*1 of the first permanent irradiation light amount p1*b*1 and the first permanent irradiation light amount p1*b*2. Note that the totalized light amount p1*t*2 may be the light amount which is not less than the first permanent curing light amount L1*b*.

Then, in the second light irradiation process, the controller 40 irradiates, during the first scanning, the light in the first permanent irradiation light amount p1*b*1 from the following light irradiator 30 onto the first base material A1 and the second base material A2. The first permanent irradiation light amount p1*b*1 is less than the first temporary curing light amount L1*a* and the second temporary curing light amount L2*a*. Therefore, the first liquid and the second liquid are not temporarily cured, and the first liquid and the second liquid remain in the uncured states.

Subsequently, the controller 40 irradiates, during the second scanning, the light in the first permanent irradiation light amount p1*b*2 from the following light irradiator 30 onto the first base material A1 and the second base material A2. Accordingly, the totalized light amount p1*t*1, which is irradiated onto the first liquid, arrives at the first temporary curing light amount L1*a*, and the first liquid is temporarily cured from the uncured state. Further, the totalized light amount p1*t*1, which is irradiated onto the second liquid, arrives at the second temporary curing light amount L2*a*, and the second liquid is temporarily cured from the uncured state. In this way, the first liquid and the second liquid are temporarily cured during the identical second scanning. Therefore, it is possible to obtain the matched textures of gloss for the cured products obtained by curing the liquids.

Further, the controller 40 irradiates, during the third scanning, the light in the first permanent irradiation light amount p1*b*3 from the following light irradiator 30 onto the first base material A1 and the second base material A2. Accordingly, the totalized light amount p1*t*2, which is irradiated onto the first liquid, arrives at the first permanent curing light amount L1*b*, and the first liquid is permanently cured from the temporary cured state. Further, the totalized light amount p1*t*2, which is irradiated onto the second liquid, does not arrive at the second permanent curing light amount L2*b*, and the second liquid is maintained in the temporary cured state.

Then, in the third light irradiation process, the controller 40 irradiates, during the third scanning, the light in the second additional irradiation light amount p2*c* from the following light irradiator 30 onto the second base material A2. Accordingly, the second liquid, which has been temporarily cured by the irradiation of the light in the totalized light amount p1*t*2 in the second light irradiation process, is permanently cured by the irradiation of the light in the second additional irradiation light amount p1*c* in the third light irradiation process. During the third scanning, the light is not irradiated from the following light irradiator 30 onto the first base material A1. Therefore, it is possible to permanently cure the first liquid and the second liquid from the uncured states, while reducing the wasteful consumption of the light energy.

Sixth Modified Embodiment

In an image recording apparatus 10 according to a sixth modified embodiment, the first position information includes the first upstream end and the first downstream end of the first base material A1 in the movement direction. The second position information includes the second upstream end and the second downstream end of the second base material A2 in the movement direction. The controller 40 starts the irradiation of the light in the third light irradiation process if the light irradiation range 34 on the recording medium A of the light irradiated from the light irradiator 30 is disposed upstream in the movement direction from the second upstream end. The controller 40 terminates the irradiation of the light if the light irradiation range 34 is disposed downstream in the movement direction from the second downstream end.

Figure 15:
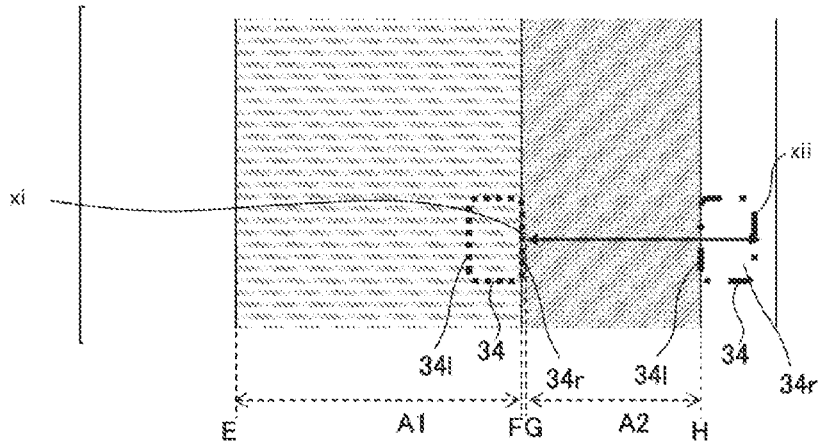
FIG. 15 explains the timing for switching the light amount in relation to an image recording apparatus according to a sixth modified embodiment of the present teaching.

For example, in an exemplary case depicted in FIG. 15, if the light irradiation range 34 is positioned during the scanning with the light irradiator 30 between the position xi (the right end 34*r* is positioned at the second left end G of the second base material A2) and the position xii (the left end 341 is positioned at the second right end H of the second base material A2), the light irradiation range 34 is overlapped with the second base material A2.

On this account, when the light irradiator 30 is moved rightwardly, then the light irradiation of the first light irradiator 30*a* is started at the left of the position xi, and the light irradiation of the first light irradiator 30*a* is terminated at the right of the position xii. Further, when the light irradiator 30 is moved leftwardly, then the light irradiation of the second light irradiator 30*b* is started at the right of the position xii, and the light irradiation of the second light irradiator 30*b* is terminated at the left of the position xi.

Seventh Modified Embodiment

In an image recording apparatus 10 according to a seventh modified embodiment, the controller 40 irradiates the light in the second light irradiation process if the irradiation position of the light irradiated from a predetermined position of the light irradiator 30 is overlapped with the first base material A1 and if the irradiation position is overlapped with the second base material A2. The controller 40 irradiates the light in the third light irradiation process if the irradiation position of the light irradiated from a predetermined position of the light irradiator 30 is overlapped with the second base material A2.

In this case, the controller 40 irradiates the light in the third irradiation light amount onto the first base material A1 and the second base material A2 if the central position of the light irradiation range 34, which corresponds to the predetermined position (for example, central position) of the light irradiator 30, is overlapped with the first base material A1 and if the central position is overlapped with the second base material A2. The controller 40 irradiates the light in the fourth irradiation light amount onto the second base material A2 if the central position of the light irradiation range 34 is overlapped with the second base material A2. Accordingly, it is possible to cure the respective liquids, while reducing the wasteful consumption of the light energy.

Third Embodiment

In an image recording apparatus 10 according to a third embodiment of the present teaching, the controller 40 executes a data acquiring process, a recording process, an information acquiring process, a curing light amount acquiring process, a second subtracting process, a recording process, a fourth light irradiation process, and a fifth light irradiation process. The data acquiring process, the recording process, and the information acquiring process of the third embodiment are the same as or equivalent to those of the first embodiment and the second embodiment.

In the curing light amount acquiring process, the first curing light amount required to cure the photocurable liquid on the first base material A1 and the second curing light amount required to cure the photocurable liquid on the second base material A2 are acquired. The first curing light amount includes the first temporary curing light amount which is required to temporarily cure the photocurable liquid on the first base material A1 from the uncured state, and the first permanent curing light amount which is required to permanently cure the photocurable liquid on the first base material A1 from the uncured state. The second curing light amount includes the second temporary curing light amount which is required to temporarily cure the photocurable liquid on the second base material A2 from the uncured state, and the second permanent curing light amount which is required to permanently cure the photocurable liquid on the second base material A2 from the uncured state.

In the second subtracting process, the controller 40 acquires the second differential light amount which is obtained by subtracting, from the first permanent curing light amount, the higher curing light amount selected from the first temporary curing light amount and the second temporary curing light amount as higher one, and the third differential light amount which is obtained by subtracting the higher curing light amount from the second permanent curing light amount.

In the fourth light irradiation process, the light in the fifth irradiation light amount corresponding to the higher curing light amount is irradiated onto the first base material A1 and the second base material A2 on the basis of the first position information and the second position information, while relatively moving the recording medium A and the light irradiator 30. In the fifth light irradiation process, the light in the sixth irradiation light amount corresponding to the second differential light amount is irradiated onto the first base material A1 on the basis of the first position information, and the light in the seventh irradiation light amount corresponding to the third differential light amount is irradiated onto the second base material A2 on the basis of the second position information, while relatively moving the recording medium A and the light irradiator 30. Each of the fifth irradiation light amount, the sixth irradiation light amount, and the seventh irradiation light amount is any one of the irradiation illuminance and the integrated light amount.

Figure 16:
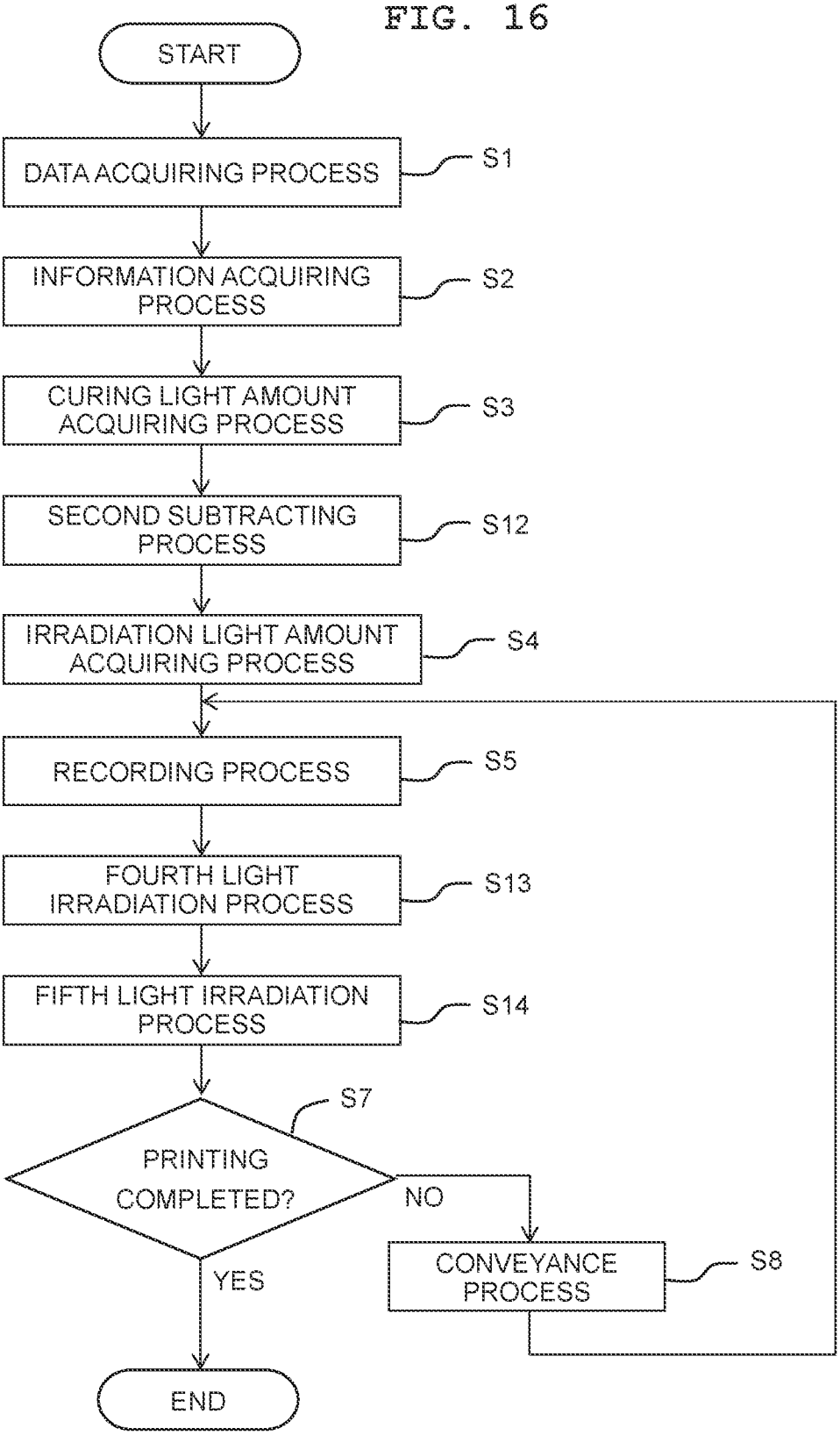
FIG. 16 depicts a flow chart illustrating an exemplary control method for an image recording apparatus according to a third embodiment of the present teaching.

For example, a control method for the image recording apparatus 10 is executed by the controller 40 in accordance with a flow chart depicted in FIG. 16. In the flow chart depicted in FIG. 16, the second subtracting process of Step S12 is executed between the curing light amount acquiring process of Step S3 depicted in FIG. 5 and the irradiation light amount acquiring process of Step S4. Further, in the flow chart depicted in FIG. 16, the fourth light irradiation process of Step S13 and the fifth light irradiation process of Step S14 are executed in place of the first light irradiation process of Step S6 depicted in FIG. 5. In the following description, an explanation will be made about a case in which the second temporary curing light amount L2*a* is higher than the first temporary curing light amount L1*a*. Note that the same or equivalent situation holds if the first temporary curing light amount L1*a* is higher than the second temporary curing light amount L2*a*.

Figure 17A:
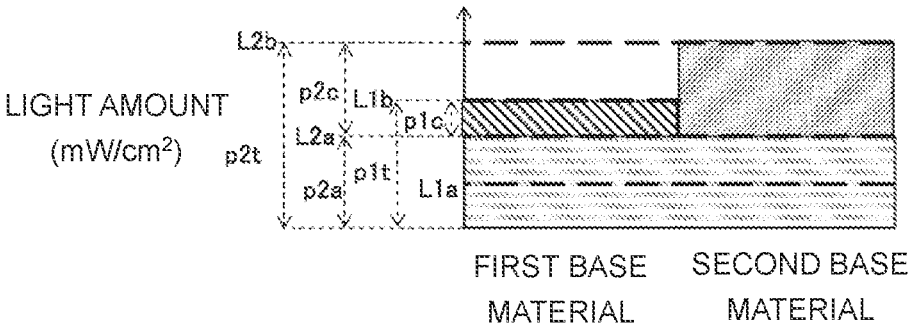
FIGS. 17A and 17B depict graphs illustrating the light amounts for respective base materials in relation to the image recording apparatus depicted in FIG. 16.

In an exemplary case depicted in FIG. 17A, the fourth light irradiation process includes the process in which the photocurable liquid on the first base material A1 and the photocurable liquid on the second base material A2 are temporarily cured from the uncured states by means of the irradiation performed once by irradiating the light in the fifth irradiation light amount once onto the first base material A1 and the second base material A2.

Specifically, the controller 40 compares, in the irradiation light amount acquiring process, the maximum light amount of the light capable of being irradiated from the light irradiator 30 with the respective curing light amounts. In this procedure, the maximum light amount of the light irradiator 30 is not less than the first temporary curing light amount L1*a* and the second temporary curing light amount L2*a* and less than the second permanent curing light amount L2*b*. Then, the controller 40 acquires the fifth irradiation light amount, the sixth irradiation light amount, and the seventh irradiation light amount on the basis of the respective curing light amounts and the maximum light amount.

The fifth irradiation light amount includes the second temporary irradiation light amount p2*a* required to temporarily cure the second liquid from the uncured state by means of the irradiation of the light performed once. The second temporary irradiation light amount p2*a* is equal to the second temporary curing light amount L2*a*. In this procedure, the second temporary curing light amount L2*a* is higher than the first temporary curing light amount L1*a*. Therefore, the first liquid is temporarily cured from the uncured state by irradiating the light in the second temporary irradiation light amount p2*a* onto the first liquid once. Note that the second temporary irradiation light amount p2*a* may be the light amount which is not less than the second temporary curing light amount L2*a* and less than the first permanent curing light amount L1*b*.

The sixth irradiation light amount includes the first additional irradiation light amount p1*c* of the light irradiated in order that the first liquid, which has been temporarily cured by the irradiation of the light in the second temporary irradiation light amount p2*a*, is permanently cured by the irradiation of the light performed once. The first additional irradiation light amount p1*c* is equal to the second differential light amount which is the difference between the first permanent curing light amount L1*b* and the second temporary curing light amount L2*a*. The totalized light amount p1*t* of the first additional irradiation light amount p1*c* and the second temporary irradiation light amount p2*a* is equal to the first permanent curing light amount L1*b*. Note that the first additional irradiation light amount p1*c* may be the light amount which is not less than the second differential light amount, and the totalized light amount p1*t* may be the light amount which is not less than the first permanent curing light amount L1*b*.

The seventh irradiation light amount includes the second additional irradiation light amount p2*c* of the light irradiated in order that the second liquid, which has been temporarily cured by the irradiation of the light in the second temporary irradiation light amount p2*a*, is permanently cured by the irradiation of the light performed once. The second additional irradiation light amount p2*c* is equal to the third differential light amount which is the difference between the second permanent curing light amount L2*b* and the second temporary curing light amount L2*a*. The totalized light amount p2*t* of the second additional irradiation light amount p2*c* and the second temporary irradiation light amount p2*a* is equal to the second permanent curing light amount L2*b*. Note that the second additional irradiation light amount p2*c* may be the light amount which is not less than the third differential light amount, and the totalized light amount p2*t* may be the light amount which is not less than the second permanent curing light amount L2*b*.

Then, in the fourth light irradiation process, the controller 40 irradiates, during the first scanning, the light in the second temporary irradiation light amount p2*a* from the following light irradiator 30 onto the first base material A1 and the second base material A2. Accordingly, both of the first liquid and the second liquid are temporarily cured from the uncured states. In this way, the first liquid and the second liquid are temporarily cured during the identical first scanning. Therefore, it is possible to obtain the matched textures of mat for the cured products obtained by curing the liquids.

Further, during the second scanning, the controller 40 executes the fifth light irradiation process and the sixth light irradiation process. In the fifth light irradiation process, the light in the first additional irradiation light amount p1*c* is irradiated from the following light irradiator 30 onto the first base material A1. In the sixth light irradiation process, the light in the second additional irradiation light amount p2*c* is irradiated from the following light irradiator 30 onto the second base material A2. Accordingly, the first liquid, which has been temporarily cured by the irradiation of the light in the second temporary irradiation light amount p2*a* in the fourth light irradiation process, is permanently cured by the irradiation of the light in the first additional irradiation light amount p1*c* in the fifth light irradiation process. Further, the second liquid, which has been temporarily cured by the irradiation of the light in the second temporary irradiation light amount p2*a* in the fourth light irradiation process, is permanently cured by the irradiation of the light in the second additional irradiation light amount p2*c* in the sixth light irradiation process. On this account, it is possible to permanently cure the first liquid and the second liquid from the uncured states, while reducing the wasteful consumption of the light energy.

Note that if the maximum light amount is less than the second differential light amount, the fifth light irradiation process may include the process in which the first liquid is permanently cured from the temporary cured state by irradiating the light in the sixth irradiation light amount a plurality of times onto the first liquid having been temporarily cured by the fourth light irradiation process. In this procedure, the sixth irradiation light amount may include a plurality of irradiation light amounts of the light irradiated to permanently cure the first liquid from the temporary cured state by means of the irradiation of the light performed a plurality of times. Note that if the maximum light amount is less than the third differential light amount, then the sixth light irradiation process is the same as or equivalent to the fifth light irradiation process, and the seventh irradiation light amount is the same as or equivalent to the sixth irradiation light amount.

Figure 17B:
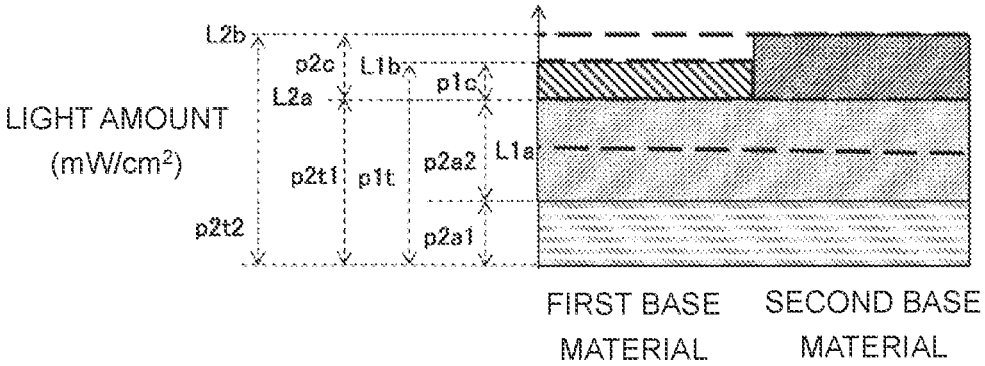

In an exemplary case depicted in FIG. 17B, the fourth light irradiation process includes the process in which the photocurable liquid on the first base material A1 and the photocurable liquid on the second base material A2 are temporarily cured from the uncured states by means of the irradiation performed a predetermined number of times, by irradiating the light in the fifth irradiation light amount a plurality of times onto the first base material A1 and the second base material A2.

Specifically, the controller 40 compares, in the irradiation light amount acquiring process, the maximum light amount of the light capable of being irradiated from the light irradiator 30 with the respective curing light amounts. In this procedure, the maximum light amount of the light irradiator 30 is less than the first temporary curing light amount L1*a* and the second temporary curing light amount L2*a*. Then, the controller 40 acquires the fifth irradiation light amount, the sixth irradiation light amount, and the seventh irradiation light amount on the basis of the respective curing light amounts and the maximum light amount.

The fifth irradiation light amount includes a plurality of second temporary irradiation light amounts p2*a*1, p2*a*2 required to temporarily cure the second liquid from the uncured state by means of the irradiation of the light performed a plurality of times (for example, twice). The totalized light amount p2*t*1 of the second temporary irradiation light amount p2*a*1 and the second temporary irradiation light amount p2*a*2 is equal to the second temporary curing light amount L2*a*. Further, the second temporary irradiation light amounts p2*a*1, p2*a*2 are set so that both of the first liquid and the second liquid are temporarily cured from the uncured states by means of the irradiation of the light performed a predetermined number of times (for example, twice). In this exemplary case, the second temporary irradiation light amounts p2*a*1, p2*a*2 are set so that the first temporary curing light amount L1*a* and the second temporary curing light amount L2*a* are higher than the second temporary irradiation light amount p2*a*1, and the first temporary curing light amount L1*a* and the second temporary curing light amount L2*a* are not less than the totalized light amount p2*t*1. Note that the totalized light amount p2*t*1 may be the light amount which is not less than the second temporary curing light amount L2*a*.

The sixth irradiation light amount depicted in FIG. 17B is the same as or equivalent to the sixth irradiation light amount depicted in FIG. 17A except that the totalized light amount p1*t* of the totalized light amount p2*t*1 and the first additional irradiation light amount p1*c* is equal to the first permanent curing light amount L1*b*. Further, the seventh irradiation light amount depicted in FIG. 17B is the same as or equivalent to the seventh irradiation light amount depicted in FIG. 17A except that the totalized light amount p2*t*2 of the totalized light amount p2*t*1 and the second additional irradiation light amount p2*c* is equal to the second permanent curing light amount L2*b*.

Then, in the fourth light irradiation process, the controller 40 irradiates, during the first scanning, the light in the second temporary irradiation light amount p2*a*1 from the following light irradiator 30 onto the first base material A1 and the second base material A2. The second temporary irradiation light amount p2*a*1 irradiated onto the first liquid does not arrive at the first temporary curing light amount L1*a*, and the second temporary irradiation light amount p2*a*1 irradiated onto the second liquid does not arrive at the second temporary curing light amount L2*a*. Therefore, the first liquid and the second liquid maintain the uncured states.

Subsequently, during the second scanning, the controller 40 irradiates the light in the second temporary irradiation light amount p2*a*2 from the following light irradiator 30 onto the first base material A1 and the second base material A2. The totalized light amount p2*t*1 irradiated onto the first liquid arrives at the first temporary curing light amount L1*a*, and the totalized light amount p2*t*1 irradiated onto the second liquid arrives at the second temporary curing light amount L2*a*. Both of the first liquid and the second liquid are temporarily cured from the uncured states. In this way, the first liquid and the second liquid are temporarily cured during the identical first scanning. Therefore, it is possible to obtain the matched textures of gloss for the cured products obtained by curing the liquids.

Further, during the third scanning, the controller 40 executes the fifth light irradiation process and the sixth light irradiation process. Accordingly, the totalized light amount p1*t* irradiated onto the first liquid arrives at the first permanent curing light amount L1*b*, and the totalized light amount p2*t*2 irradiated onto the second liquid arrives at the second permanent curing light amount L2*b*. Both of the first liquid and the second liquid are permanently cured from the temporary cured states. Therefore, it is possible to permanently cure the first liquid and the second liquid from the uncured states, while reducing the wasteful consumption of the light energy.

Other Modified Embodiments

In all of the embodiments and all of the modified embodiments described above, the movement mechanism 13 moves the head 20 and the light irradiator 30 in the left-right direction, without moving the recording medium A. However, the movement mechanism 13 may relatively move the recording medium A, and the head 20 and the light irradiator 30 in the left-right direction. On this account, it is also allowable that the movement mechanism 13 moves the recording medium A in the left-right direction, without moving the head 20 and the light irradiator 30. Further, the movement mechanism 13 may move the recording medium A, and the head 20 and the light irradiator 30 in the left-right direction.

In all of the embodiments and all of the modified embodiments described above, the serial head system is used for the image recording apparatus 10. However, it is also allowable to use the line head system. In this case, the movement mechanism 13 has the conveyor 60 without having the scanning device 50. Accordingly, the head 20 is not moved in the left-right direction, and the recording medium A and the head 20 are relatively moved by means of the conveyor 60.

Note that all of the embodiments described above may be combined with each other, provided that there is no mutual exclusion between the combined embodiments. Further, according to the foregoing explanation, it is obvious for those skilled in the art to think of many improvements and other embodiments of the present teaching. Therefore, the foregoing explanation should be interpreted as only exemplification, which is provided in order to teach the best mode for carrying out the present teaching to those skilled in the art. Details of the structure and/or the function can be substantially changed without deviating from the spirit of the present teaching.

What is claimed is:

1. An image recording apparatus comprising:

a head having nozzles configured to discharge photocurable liquid that is curable by light toward a recording medium, the recording medium including a first base material and a second base material having a surface state different from a surface state of the first base material;

a light irradiator configured to irradiate the light to the photocurable liquid disposed on the recording medium;

a movement mechanism configured to relatively move the recording medium, and the head and the light irradiator in a movement direction; and a controller configured to execute:

discharging the photocurable liquid to the first base material and the second base material while relatively moving the recording medium and the head;

acquiring first position information of the first base material and second position information of the second base material;

acquiring a first irradiation light amount of the light which is to be irradiated to cure the photocurable liquid on the first base material and a second irradiation light amount of the light which is different from the first irradiation light amount and which is to be irradiated to cure the photocurable liquid on the second base material; and controlling the light irradiator to irradiate the light in the first irradiation light amount onto the first base material and to irradiate the light in the second irradiation light amount onto the second base material based on the first position information and the second position information while relatively moving the recording medium and the light irradiator.

2. The image recording apparatus according to claim 1, wherein each of the first irradiation light amount and the second irradiation light amount is any one of irradiation amounts of an irradiation illuminance per unit time per unit area on the recording medium of the light irradiated from the light irradiator and an integrated light amount per unit area on the recording medium of the light irradiated from the light irradiator.

3. The image recording apparatus according to claim 1, wherein in a case of controlling the light irradiator, the controller is configured to switch the irradiation light amount between the first irradiation light amount and the second irradiation light amount under a condition that a light irradiation range on the recording medium of the light irradiated from the light irradiator is disposed between the first base material and the second base material.

4. The image recording apparatus according to claim 1, wherein in a case of controlling the light irradiator, the controller is configured to cause the light irradiator to irradiate the light in an irradiation light amount which is selected as a larger light amount from the first irradiation light amount and the second irradiation light amount at a mixture position at which a light irradiation range in the movement direction on the recording medium of the light irradiated from the light irradiator overlaps with the first base material and the second base material.

5. The image recording apparatus according to claim 1, wherein in a case of acquiring the first irradiation light amount, the controller is configured to: accept a switching position for switching the irradiation amount between the first irradiation amount and the second irradiation amount of the light irradiated from the light irradiator in the first light irradiation process; and acquire the first position information and the second position information based on the switching position.

6. The image recording apparatus according to claim 1, wherein in a case of controlling the light irradiator, the controller is configured to cause the light irradiator to:

irradiate the light in the first irradiation light amount under a condition that the irradiation position of the light from a predetermined position of the light irradiator is disposed on the first base material; and irradiate the light in the second irradiation light amount under a condition that the irradiation position of the light from the predetermined position of the light irradiator is disposed on the second base material.

7. The image recording apparatus according to claim 1, wherein in a case of controlling the light irradiator, the controller is configured to:

cause the light irradiator to irradiate the light in the first irradiation light amount once or a plurality of times onto the first base material such that the photocurable liquid on the first base material is permanently cured from an uncured state; and cause the light irradiator to irradiate the light in the second irradiation light amount once or a plurality of times onto the second base material such that the photocurable liquid on the second base material is temporarily cured or permanently cured from an uncured state.

8. The image recording apparatus according to claim 1, wherein in a case of controlling the light irradiator, the controller is configured to:

cause the light irradiator to irradiate the light in the first irradiation light amount once or a plurality of times onto the first base material such that the photocurable liquid on the first base material is temporarily cured from an uncured state; and cause the light irradiator to irradiate the light in the second irradiation light amount the plurality of times onto the second base material such that the photocurable liquid on the second base material is temporarily cured from an uncured state.

9. The image recording apparatus according to claim 8, wherein in a case of controlling the light irradiator, the controller is configured to:

cause the light irradiator to irradiate the light in the first irradiation light amount once or a plurality of times onto the temporarily cured photocurable liquid on the first base material such that the temporarily cured photocurable liquid is permanently cured; and cause the light irradiator to irradiate the light in the second irradiation light amount once or a plurality of times onto the temporarily cured photocurable liquid on the second base material such that the temporarily cured photocurable liquid is permanently cured.

10. The image recording apparatus according to claim 1, wherein the movement mechanism includes:

a carriage which is configured to move to an outward route side and a homeward route side in the movement direction while carrying the head and the light irradiator; and a conveyor which is configured to convey the recording medium in a conveying direction intersecting the movement direction.

11. An image recording apparatus comprising:

a head having nozzles configured to discharge photocurable liquid that is curable by light toward a recording medium, the recording medium including a first base material and a second base material different from the first base material;

a light irradiator configured to irradiate the light to the photocurable liquid disposed on the recording medium;

a movement mechanism configured to relatively move the recording medium, and the head and the light irradiator in a movement direction; and a controller configured to execute:

discharging the photocurable liquid to the first base material and the second base material while relatively moving the recording medium and the head;

acquiring first position information of the first base material and second position information of the second base material;

acquiring a first permanent curing light amount which is required to permanently cure the photocurable liquid on the first base material from an uncured state and a second permanent curing light amount which is higher than the first permanent curing light amount and which is required to permanently cure the photocurable liquid on the second base material from an uncured state;

acquiring a first differential light amount obtained by subtracting the first permanent curing light amount from the second permanent curing light amount;

irradiating the light in a third irradiation light amount corresponding to the first permanent curing light amount onto the first base material and the second base material based on the first position information and the second position information while relatively moving the recording medium and the light irradiator; and irradiating the light in a fourth irradiation light amount corresponding to the first differential light amount onto the second base material based on the second position information while relatively moving the recording medium and the light irradiator.

12. The image recording apparatus according to claim 11, wherein in a case of irradiating the light in the third irradiation light amount, the controller is configured to cause the light irradiator to irradiate the light in the third irradiation light amount once or a plurality of times onto the first base material and the second base material such that the photocurable liquid disposed on the first base material is permanently cured from an uncured state and the photocurable liquid disposed on the second base material is temporarily cured from an uncured state.

13. The image recording apparatus according to claim 11, wherein in a case of irradiating the light in the third irradiation light amount, the controller is configured to cause the light irradiator to irradiate the light in the third irradiation light amount once or a plurality of times onto the first base material and the second base material such that the photocurable liquid disposed on the first base material and the photocurable liquid disposed on the second base material are temporarily cured from uncured states.

14. The image recording apparatus according to claim 11, wherein:

the first position information includes a first upstream end and a first downstream end of the first base material in the movement direction;

the second position information includes a second upstream end and a second downstream end of the second base material in the movement direction;

in a case of irradiating the light in the fourth irradiation light amount, the controller is configured to:

cause the light irradiator to start the irradiation of the light under a condition that a light irradiation range on the recording medium of the light irradiated from the light irradiator is disposed upstream in the movement direction from the second upstream end; and cause the light irradiator to terminate the irradiation of the light under a condition that the light irradiation range is disposed downstream in the movement direction from the second downstream end.

15. The image recording apparatus according to claim 11, wherein:

the controller is configured to cause the light irradiator to irradiate the light in the second light irradiation process under a condition that the irradiation position of the light from a predetermined position of the light irradiator is disposed on the first base material and the second base material; and the controller is configured to cause the light irradiator to irradiate the light in the third light irradiation process under a condition that the irradiation position of the light from a predetermined position of the light irradiator is disposed on the second base material.

16. The image recording apparatus according to claim 11, wherein each of the third irradiation light amount and the fourth irradiation light amount is any one of an irradiation illuminance per unit time per unit area on the recording medium of the light irradiated from the light irradiator and an integrated light amount per unit area on the recording medium of the light irradiated from the light irradiator.

17. An image recording apparatus comprising:

a head having nozzles configured to discharge photocurable liquid that is curable by light toward a recording medium, the recording medium including a first base material and a second base material different from the first base material;

a light irradiator configured to irradiate the light to the photocurable liquid disposed on the recording medium;

a movement mechanism configured to relatively move the recording medium, and the head and the light irradiator in a movement direction; and a controller configured to execute:

discharging the photocurable liquid to the first base material and the second base material while relatively moving the recording medium and the head;

acquiring first position information of the first base material and second position information of the second base material;

acquiring a first curing light amount which is required to cure the photocurable liquid on the first base material and a second curing light amount which is required to cure the photocurable liquid on the second base material;

the first curing light amount having a first temporary curing light amount which is required to temporarily cure the photocurable liquid on the first base material from an uncured state and a first permanent curing light amount which is required to permanently cure the photocurable liquid on the first base material from the uncured state; and the second curing light amount having a second temporary curing light amount which is required to temporarily cure the photocurable liquid on the second base material from an uncured state and a second permanent curing light amount which is required to permanently cure the photocurable liquid on the second base material from the uncured state;

acquiring a second differential light amount obtained by subtracting a higher curing light amount as higher one of the first temporary curing light amount and the second temporary curing light amount from the first permanent curing light amount, and a third differential light amount obtained by subtracting the higher curing light amount from the second permanent curing light amount;

irradiating the light in a fifth irradiation light amount corresponding to the higher curing light amount onto the first base material and the second base material based on the first position information and the second position information while relatively moving the recording medium and the light irradiator; and irradiating the light in a sixth irradiation light amount corresponding to the second differential light amount onto the first base material based on the first position information and irradiating the light in a seventh irradiation light amount corresponding to the third differential light amount onto the second base material based on the second position information while relatively moving the recording medium and the light irradiator.

18. The image recording apparatus according to claim 17, wherein in a case of irradiating the light in a fifth irradiation light amount, the controller is configured to cause the light irradiator to irradiate the light in the fifth irradiation light amount once or a plurality of times onto the first base material and the second base material such that the photocurable liquid disposed on the first base material and the photocurable liquid disposed on the second base material are temporarily cured from uncured states.

19. The image recording apparatus according to claim 17, wherein each of the fifth irradiation light amount, the sixth irradiation light amount, and the seventh irradiation intensity light amount is any one of an irradiation illuminance per unit time per unit area on the recording medium of the light irradiated from the light irradiator and an integrated light amount per unit area on the recording medium of the light irradiated from the light irradiator.

20. A non-transitory medium storing a program for an image recording apparatus comprising: a head having nozzles configured to discharge photocurable liquid that is curable by light toward a recording medium, the recording medium including a first base material and a second base material having a surface state different from a surface state of the first base material; a light irradiator configured to irradiate the light to the photocurable liquid disposed on the recording medium; a movement mechanism configured to relatively move the recording medium, and the head and the light irradiator in a movement direction; and a controller, the program causing the controller to execute:

discharging the photocurable liquid to the first base material and the second base material while relatively moving the recording medium and the head;

acquiring first position information of the first base material and second position information of the second base material;

acquiring a first irradiation light amount of the light which is to be irradiated to cure the photocurable liquid on the first base material and a second irradiation light amount of the light which is different from the first irradiation light amount and which is to be irradiated to cure the photocurable liquid on the second base material; and irradiating the light in the first irradiation light amount onto the first base material and irradiating the light in the second irradiation light amount onto the second base material based on the first position information and the second position information while relatively moving the recording medium and the light irradiator.

* * * * *